US012082639B2

(12) United States Patent
Lang et al.

(10) Patent No.: US 12,082,639 B2
(45) Date of Patent: Sep. 10, 2024

(54) SHOE UPPER

(71) Applicant: adidas AG, Herzogenaurach (DE)

(72) Inventors: Astrid Karin Lang, Wilhermsdorf (DE); Stefan Tamm, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 84 days.

(21) Appl. No.: 16/130,995

(22) Filed: Sep. 13, 2018

(65) Prior Publication Data

US 2019/0075889 A1 Mar. 14, 2019

Related U.S. Application Data

(63) Continuation of application No. 13/861,896, filed on Apr. 12, 2013, now abandoned.

(30) Foreign Application Priority Data

Apr. 13, 2012 (DE) ..... 102012206062.6
Mar. 27, 2013 (EP) ..... 13161357

(51) Int. Cl.

| | |
|---|---|
| ***A43B 1/04*** | (2022.01) |
| ***A43B 23/02*** | (2006.01) |
| ***D04B 1/16*** | (2006.01) |
| ***D04B 1/22*** | (2006.01) |

(52) U.S. Cl.

CPC ..... *A43B 1/04* (2013.01); *A43B 23/0205* (2013.01); *A43B 23/0235* (2013.01); *D04B 1/16* (2013.01); *D04B 1/22* (2013.01); *A43B 23/025* (2013.01); *A43B 23/026* (2013.01); *A43B 23/0265* (2013.01); *D10B 2501/043* (2013.01)

(58) Field of Classification Search

CPC ... A43B 1/04; A43B 23/0225; A43B 23/0235; A43B 23/026

See application file for complete search history.

(56) References Cited

U.S. PATENT DOCUMENTS

| | | | |
|---|---|---|---|
| 74,962 | A | 2/1868 | Martin |
| 275,142 | A | 4/1883 | Carter |
| 299,934 | A | 6/1884 | Müller |
| 467,091 | A | 1/1892 | Max |
| 578,153 | A | 3/1897 | Lamb |
| 601,192 | A | 3/1898 | Woodside |

(Continued)

FOREIGN PATENT DOCUMENTS

| | | | |
|---|---|---|---|
| AT | 386324 | B | 8/1988 |
| CA | 989720 | A1 | 5/1976 |

(Continued)

OTHER PUBLICATIONS

Santoni S.p.A. publication: Knitting Wear, SM8 Top 1 (2 pages).

(Continued)

*Primary Examiner* — Megan E Lynch
(74) *Attorney, Agent, or Firm* — Sterne, Kessler, Goldstein & Fox P.L.L.C.

(57) ABSTRACT

A shoe upper for a shoe, in particular a sports shoe, is provided having a first portion and a second portion that are jointly manufactured as a knitted fabric, wherein only one of the first portion and the second portion the knitted fabric is reinforced by a coating of a polymer material applied to the shoe upper.

17 Claims, 6 Drawing Sheets

(56) References Cited

U.S. PATENT DOCUMENTS

| | | | |
|---|---|---|---|
| 601,894 | A | 4/1898 | Lamb |
| D31,023 | S | 6/1899 | Olmsted |
| 757,424 | A | 4/1904 | Vohl |
| 872,163 | A | 11/1907 | Williams |
| 951,033 | A | 3/1910 | Steber |
| 1,215,198 | A | 2/1917 | Rothstein |
| 1,346,516 | A | 7/1920 | Godfrey |
| 1,370,799 | A | 3/1921 | Egerton |
| 1,413,314 | A | 4/1922 | Bosworth |
| 1,413,537 | A | 4/1922 | Jones |
| 1,538,263 | A | 5/1925 | Ackerman |
| 1,597,934 | A | 8/1926 | Stimpson |
| 1,811,803 | A | 6/1931 | Oakley |
| 1,841,518 | A | 1/1932 | Bellak |
| 1,869,386 | A | 8/1932 | Marzak |
| 1,888,172 | A | 11/1932 | Joha |
| 1,902,780 | A | 3/1933 | Holden et al. |
| RE18,804 | E | 4/1933 | Joha |
| 1,910,251 | A | 5/1933 | Joha |
| 1,972,609 | A | 9/1934 | Arsdale et al. |
| 2,001,293 | A | 5/1935 | Wilson |
| 2,018,275 | A | 10/1935 | Markowitz |
| 2,024,180 | A | 12/1935 | Parlante |
| 2,038,844 | A | 4/1936 | Dorf |
| 2,042,146 | A | 5/1936 | Deakin |
| 2,047,724 | A | 7/1936 | Zuckerman |
| 2,048,294 | A | 7/1936 | Roberts |
| 2,069,083 | A | 1/1937 | Percy |
| 2,076,285 | A | 4/1937 | Wiggin |
| 2,126,186 | A | 8/1938 | Friedland |
| 2,147,197 | A | 2/1939 | Glidden |
| 2,150,730 | A | 3/1939 | Schuessler |
| 2,165,092 | A | 7/1939 | Daniels |
| 2,171,654 | A | 9/1939 | Ralph et al. |
| 2,178,941 | A | 11/1939 | Schuessler |
| 2,257,390 | A | 9/1941 | Roy |
| 2,276,920 | A | 3/1942 | Charles et al. |
| 2,292,455 | A | 8/1942 | Hollier et al. |
| 2,297,028 | A | 9/1942 | Sheeler |
| 2,302,167 | A | 11/1942 | Austin |
| 2,314,098 | A | 3/1943 | McDonald |
| 2,319,141 | A | 5/1943 | Kuehnel |
| 2,330,199 | A | 9/1943 | Basch |
| 2,343,390 | A | 3/1944 | Ushakoff |
| 2,364,134 | A | 12/1944 | Dildilian et al. |
| 2,371,689 | A | 3/1945 | John et al. |
| 2,391,564 | A | 12/1945 | Jon |
| 2,391,594 | A | 12/1945 | Provenzano |
| 2,400,487 | A | 5/1946 | Clark et al. |
| 2,400,692 | A | 5/1946 | Herbert |
| 2,424,957 | A | 7/1947 | Schletter |
| 2,440,393 | A | 4/1948 | Clark |
| 2,460,674 | A | 2/1949 | Bihaly |
| 2,464,301 | A | 3/1949 | Francis, Jr. |
| 2,467,237 | A | 4/1949 | Sherman et al. |
| 2,467,821 | A | 4/1949 | Jon |
| 2,516,697 | A | 7/1950 | Haddad |
| 2,538,673 | A | 1/1951 | Donahue |
| 2,569,764 | A | 10/1951 | Jonas |
| 2,584,084 | A | 1/1952 | Rubico |
| 2,586,045 | A | 2/1952 | Hoza |
| 2,603,891 | A | 7/1952 | Gustav |
| 2,608,078 | A | 8/1952 | Anderson |
| 2,623,373 | A | 12/1952 | Vogel |
| 2,641,004 | A | 6/1953 | Whiting et al. |
| 2,675,631 | A | 4/1954 | Doughty |
| 2,679,117 | A | 5/1954 | Reed |
| 2,701,458 | A | 2/1955 | Ducharme |
| 2,712,744 | A | 7/1955 | Miller et al. |
| 2,714,813 | A | 8/1955 | Hill |
| 2,783,631 | A | 3/1957 | Sumner |
| 2,811,029 | A | 10/1957 | Conner |
| 2,848,885 | A | 8/1958 | Goodman |
| 2,898,754 | A | 8/1959 | Harms |
| 2,934,839 | A | 5/1960 | Servin |
| 2,948,132 | A | 8/1960 | Gift |
| 2,966,785 | A | 1/1961 | Goff et al. |
| 2,983,128 | A | 5/1961 | Clarence et al. |
| 2,994,322 | A | 8/1961 | Cullen et al. |
| 2,995,838 | A | 8/1961 | Servin |
| 3,004,354 | A | 10/1961 | Lewis |
| 3,013,564 | A | 12/1961 | Harold |
| 3,015,943 | A | 1/1962 | Guy |
| 3,035,291 | A | 5/1962 | Bingham, Jr. |
| 3,063,074 | A | 11/1962 | Scholl |
| 3,070,909 | A | 1/1963 | Hermann et al. |
| 3,078,699 | A | 2/1963 | Huntley |
| 3,093,916 | A | 6/1963 | Hiestand et al. |
| 3,138,880 | A | 6/1964 | Kunzli |
| 3,159,988 | A | 12/1964 | Reymes |
| 3,217,336 | A | 11/1965 | Joseph |
| 3,228,819 | A | 1/1966 | Bingham, Jr. |
| 3,252,484 | A | 5/1966 | Peter et al. |
| 3,298,204 | A | 1/1967 | Hoffecker |
| 3,324,220 | A | 6/1967 | Stansfield |
| 3,370,363 | A | 2/1968 | Kaplan |
| 3,383,782 | A | 5/1968 | McGinnity |
| 3,416,174 | A | 12/1968 | Novitske |
| 3,425,246 | A | 2/1969 | Knohl |
| 3,463,692 | A | 8/1969 | Brunner et al. |
| 3,550,402 | A | 12/1970 | Colton |
| 3,567,567 | A | 3/1971 | Sherrill et al. |
| 3,583,081 | A | 6/1971 | Hayashi |
| 3,616,149 | A | 10/1971 | Wincklhofer et al. |
| 3,620,892 | A | 11/1971 | Winckholfer |
| 3,635,051 | A | 1/1972 | Betts et al. |
| 3,656,323 | A | 4/1972 | Brown |
| 3,694,940 | A | 10/1972 | Stohr |
| 3,695,063 | A | 10/1972 | Betts et al. |
| 3,704,474 | A | 12/1972 | Winkler |
| 3,766,566 | A | 10/1973 | Tadokoro et al. |
| 3,769,723 | A | 11/1973 | Masterson et al. |
| 3,778,856 | A | 12/1973 | Christie et al. |
| 3,785,173 | A | 1/1974 | Hanney et al. |
| 3,816,211 | A | 6/1974 | Haigh |
| 3,838,583 | A | 10/1974 | Rumi et al. |
| 3,863,272 | A | 2/1975 | Guille |
| 3,867,248 | A | 2/1975 | Bauer |
| 3,884,052 | A | 5/1975 | Findlay et al. |
| 3,952,427 | A | 4/1976 | von den Benken et al. |
| 3,967,390 | A | 7/1976 | Anfruns |
| 3,971,234 | A | 7/1976 | Taylor |
| 3,972,086 | A | 8/1976 | Belli et al. |
| 3,985,003 | A | 10/1976 | Reed |
| 3,985,004 | A | 10/1976 | Johnson et al. |
| 4,027,402 | A | 6/1977 | Liu et al. |
| 4,028,910 | A | 6/1977 | Wignall et al. |
| 4,031,586 | A | 6/1977 | von den Benken et al. |
| 4,038,699 | A | 8/1977 | Burn |
| 4,038,840 | A | 8/1977 | Castello |
| 4,068,395 | A | 1/1978 | Senter |
| 4,075,383 | A | 2/1978 | Anderson et al. |
| 4,111,008 | A | 9/1978 | Robinson et al. |
| 4,120,101 | A | 10/1978 | Drew |
| 4,133,118 | A | 1/1979 | Khalsa et al. |
| 4,144,727 | A | 3/1979 | Duhl et al. |
| 4,183,156 | A | 1/1980 | Rudy et al. |
| 4,211,806 | A | 7/1980 | Civardi et al. |
| 4,219,945 | A | 9/1980 | Rudy et al. |
| 4,232,458 | A | 11/1980 | Bartels |
| 4,233,758 | A | 11/1980 | Auberry |
| 4,255,949 | A | 3/1981 | Thorneburg |
| 4,258,480 | A | 3/1981 | Famolare et al. |
| 4,265,954 | A | 5/1981 | Romanek |
| 4,276,671 | A | 7/1981 | Melton |
| 4,279,049 | A | 7/1981 | Coiquaud |
| 4,282,657 | A | 8/1981 | Antonious |
| 4,306,315 | A | 12/1981 | Castiglia |
| 4,306,929 | A | 12/1981 | Menikheim et al. |
| 4,317,292 | A | 3/1982 | Melton |
| 4,324,752 | A | 4/1982 | Newton et al. |
| 4,354,318 | A | 10/1982 | Frederick et al. |
| 4,356,643 | A | 11/1982 | Kester et al. |
| 4,373,361 | A | 2/1983 | Thorneburg |

(56) References Cited

U.S. PATENT DOCUMENTS 4,430,811 A 2/1984 Okada
4,447,967 A * 5/1984 Zaino ..... A43B 23/0235 36/45
4,465,448 A 8/1984 Aldridge et al.
4,467,626 A 8/1984 Coble et al.
4,517,910 A 5/1985 Jalowsky
4,523,346 A 6/1985 Auberry et al.
4,531,525 A 7/1985 Richards
4,592,154 A 6/1986 Oatman
4,607,439 A 8/1986 Harada
4,610,685 A 9/1986 Raley
4,624,115 A 11/1986 Safrit et al.
4,642,915 A 2/1987 Pfander
4,651,354 A 3/1987 Petrey
4,658,515 A 4/1987 Oatman
4,663,946 A 5/1987 Wright
4,669,126 A 6/1987 Jones
4,682,479 A 7/1987 Pernick
4,722,202 A 2/1988 Imboden
4,729,179 A 3/1988 Quist et al.
4,737,396 A 4/1988 Kamat et al.
4,750,339 A 6/1988 Simpson, Jr. et al.
4,756,098 A 7/1988 Boggia
4,783,355 A 11/1988 Mueller
4,785,558 A 11/1988 Shiomura
4,788,922 A 12/1988 Clarius
4,813,158 A 3/1989 Brown
4,813,161 A 3/1989 Lesley
4,852,272 A 8/1989 Chilewich et al.
4,891,958 A * 1/1990 Cournoyer ..... D04B 1/104 66/196
4,899,465 A 2/1990 Bleimhofer et al.
4,941,331 A 7/1990 Cournoyer et al.
4,960,135 A 10/1990 Nelson
5,031,423 A 7/1991 Ikenaga et al.
5,052,130 A 10/1991 Barry et al.
5,095,720 A 3/1992 Tibbals, Jr.
5,117,567 A 6/1992 Berger et al.
5,125,116 A 6/1992 Gaither et al.
5,152,025 A 10/1992 Hirmas et al.
5,157,791 A 10/1992 Woodson et al.
5,181,278 A 1/1993 Peleg et al.
5,192,601 A 3/1993 Neisler
5,240,773 A 8/1993 Dunn et al.
5,253,434 A 10/1993 Curley, Jr. et al.
5,291,671 A 3/1994 Caberlotto et al.
5,319,807 A 6/1994 Brier
5,323,627 A 6/1994 Lonati et al.
5,343,639 A 9/1994 Kilgore et al.
5,345,638 A 9/1994 Nishida
5,353,523 A 10/1994 Kilgore et al.
5,353,524 A 10/1994 Brier
5,371,957 A 12/1994 Gaudio et al.
5,373,713 A 12/1994 Miller
5,385,036 A 1/1995 Spillane et al.
5,388,430 A 2/1995 Essig
5,426,869 A 6/1995 Gore et al.
5,461,884 A 10/1995 Depoe et al.
5,479,791 A 1/1996 Osborne
5,484,646 A 1/1996 Mann
5,505,011 A 4/1996 Bleimhofer et al.
5,511,323 A 4/1996 Dahlgren
5,513,450 A 5/1996 Aviles Palazzo
5,519,894 A 5/1996 Imboden et al.
5,526,584 A 6/1996 Bleimhofer et al.
5,553,468 A 9/1996 Osborne
5,560,227 A 10/1996 Depoe et al.
5,572,860 A 11/1996 Mitsumoto et al.
5,575,090 A 11/1996 Condini
5,581,817 A 12/1996 Hicks
5,592,836 A 1/1997 Schuster et al.
5,605,060 A 2/1997 Osborne
5,606,808 A 3/1997 Gilliard et al.
5,617,585 A 4/1997 Fons et al.
5,623,734 A 4/1997 PUgliatti
5,623,840 A 4/1997 Roell
5,647,150 A * 7/1997 Romanato ..... A43B 3/0084 12/142 R
5,680,825 A 10/1997 Humble
5,709,107 A 1/1998 Jeffcoat
5,711,093 A 1/1998 Aumann
5,711,168 A 1/1998 Proctor et al.
5,722,262 A 3/1998 Proctor et al.
5,729,918 A 3/1998 Smets et al.
5,735,145 A 4/1998 Pernick
5,737,857 A 4/1998 Aumann
5,737,943 A 4/1998 Bernhardt
5,746,013 A 5/1998 Fay, Sr.
5,765,296 A 6/1998 Ludemann et al.
5,774,898 A 7/1998 Malpee
5,784,806 A 7/1998 Wendt
5,787,503 A 8/1998 Murphy, III
5,791,163 A 8/1998 Throneburg
5,836,179 A 11/1998 Van
5,850,745 A 12/1998 Albright
5,855,123 A 1/1999 Albright
5,884,419 A 3/1999 Davidowitz et al.
5,896,608 A 4/1999 Whatley
5,896,683 A * 4/1999 Foxen ..... A43B 7/20 36/89
5,896,758 A 4/1999 Rock et al.
5,906,007 A 5/1999 Roberts
5,996,189 A 12/1999 Wang et al.
6,021,585 A 2/2000 Cole
6,029,376 A * 2/2000 Cass ..... A43C 1/04 36/50.1
6,032,387 A 3/2000 Johnson
6,052,921 A 4/2000 Oreck
6,088,936 A 7/2000 Bahl et al.
6,109,068 A 8/2000 Stoll et al.
6,128,835 A 10/2000 Thatcher
6,151,802 A 11/2000 Reynolds et al.
6,158,253 A 12/2000 Frank et al.
6,170,175 B1 1/2001 Funk et al.
6,173,589 B1 1/2001 Hayes, Jr. et al.
6,192,717 B1 2/2001 Rabinowicz
6,196,030 B1 3/2001 Stoll et al.
6,227,010 B1 5/2001 Roell
6,231,946 B1 5/2001 Brown, Jr. et al.
6,250,115 B1 6/2001 Suzuki
6,272,888 B1 8/2001 Fujita et al.
6,286,233 B1 9/2001 Gaither
6,287,168 B1 9/2001 Rabinowicz
6,299,962 B1 10/2001 Davis et al.
6,301,759 B1 10/2001 Langer et al.
6,308,438 B1 10/2001 Throneburg et al.
6,330,814 B1 12/2001 Fujiwara
6,333,105 B1 12/2001 Tanaka et al.
6,401,364 B1 6/2002 Burt et al.
6,415,632 B1 7/2002 Vesnaver
6,430,844 B1 8/2002 Otis et al.
6,449,878 B1 9/2002 Lyden
6,482,492 B1 11/2002 Hung
6,539,752 B1 4/2003 Apollonio
6,558,784 B1 5/2003 Norton et al.
6,588,237 B2 7/2003 Cole et al.
6,622,312 B2 9/2003 Rabinowicz
6,662,469 B2 12/2003 Belley et al.
6,665,955 B1 12/2003 Mizrahi et al.
6,708,348 B1 3/2004 Romay
6,735,988 B1 5/2004 Honeycutt
6,754,983 B2 6/2004 Hatfield et al.
6,779,369 B2 8/2004 Shepherd
6,871,515 B1 3/2005 Starbuck et al.
6,886,367 B2 5/2005 Mitchell et al.
6,899,591 B2 5/2005 Mitchell
6,910,288 B2 6/2005 Dua
6,922,917 B2 8/2005 Kerns et al.
6,931,762 B1 8/2005 Dua
6,931,767 B2 * 8/2005 Royle ..... A01K 13/007 119/850
6,944,975 B2 9/2005 Safdeye et al.
6,984,596 B2 1/2006 Dickerson
6,986,183 B2 1/2006 Delgorgue et al.

(56) References Cited

U.S. PATENT DOCUMENTS 6,986,269 B2 1/2006 Dua
D517,297 S 3/2006 Jones et al.
7,016,867 B2 3/2006 Lyden
7,037,571 B2 5/2006 Fish et al.
7,043,942 B2 5/2006 Chapman
7,047,668 B2 5/2006 Burris et al.
7,051,460 B2 5/2006 Orei et al.
7,055,267 B2 6/2006 Wilson et al.
7,056,402 B2 6/2006 Koerwien et al.
7,081,221 B2 7/2006 Paratore et al.
7,107,235 B2 9/2006 Lyden
7,131,296 B2 11/2006 Dua et al.
7,179,414 B2 2/2007 Safdeye et al.
7,207,125 B2 4/2007 Jeppesen et al.
7,207,196 B2 4/2007 Lonati et al.
7,207,961 B1 4/2007 Benton et al.
7,240,522 B2 7/2007 Kondou et al.
7,346,935 B1 3/2008 Patterson et al.
7,347,011 B2 3/2008 Dua et al.
7,356,946 B2 4/2008 Hannon et al.
7,441,348 B1 10/2008 Dawson et al.
7,484,318 B2 2/2009 Finkelstein
7,543,397 B2 6/2009 Kilgore et al.
7,568,298 B2 8/2009 Kerns et al.
7,574,818 B2 8/2009 Meschter
7,637,032 B2 12/2009 Sokolowski et al.
7,650,705 B2 1/2010 Donnadieu et al.
7,677,061 B2 3/2010 Mori et al.
7,682,219 B2 3/2010 Falla
7,721,575 B2 5/2010 Yokoyama
7,774,956 B2 8/2010 Dua et al.
7,805,859 B2 10/2010 Finkelstein
7,805,860 B2 10/2010 Fliri et al.
7,814,598 B2 10/2010 Dua et al.
7,854,076 B2 12/2010 Keppler et al.
7,870,681 B2 1/2011 Meschter
7,882,648 B2 2/2011 Langvin
8,028,440 B2 10/2011 Sokolowski et al.
8,042,288 B2 10/2011 Dua et al.
8,099,881 B2 1/2012 Yamamoto
8,196,317 B2 6/2012 Dua et al.
8,209,883 B2 7/2012 Lyden
8,215,132 B2 7/2012 Dua et al.
8,225,530 B2 7/2012 Sokolowski et al.
8,266,749 B2 9/2012 Due et al.
8,296,970 B2 10/2012 Jessiman et al.
D673,765 S 1/2013 Parker et al.
8,448,474 B1 5/2013 Tatler et al.
8,464,383 B2 6/2013 Sing et al.
8,490,299 B2 7/2013 Dua et al.
8,522,577 B2 9/2013 Huffa
8,590,345 B2 11/2013 Sokolowski et al.
8,595,878 B2 12/2013 Farris et al.
8,621,891 B2 1/2014 Shaffer et al.
8,647,460 B1 2/2014 Koo et al.
8,650,916 B2 2/2014 Thomas et al.
8,683,718 B2 4/2014 Fliri et al.
8,701,232 B1 4/2014 Droege et al.
8,745,895 B2 6/2014 Sokolowski et al.
8,745,896 B2 6/2014 Shaffer et al.
8,800,172 B2 8/2014 Dua et al.
8,839,532 B2 9/2014 Shaffer et al.
8,881,430 B2 11/2014 Baines et al.
8,898,932 B2 12/2014 Molyneux et al.
8,899,079 B2 12/2014 Podhajny et al.
8,959,800 B2 2/2015 Sokolowski et al.
8,959,959 B1 2/2015 Podhajny et al.
8,973,410 B1 3/2015 Podhajny et al.
8,978,422 B2 3/2015 Podhajny et al.
8,997,529 B1 4/2015 Podhajny et al.
8,997,530 B1 4/2015 Podhajny
9,003,836 B1 4/2015 Podhajny et al.
9,010,157 B1 4/2015 Podhajny et al.
9,027,260 B2 5/2015 Shaffer et al.
9,032,763 B2 5/2015 Meir et al.
9,060,562 B2 6/2015 Meir et al.
9,072,335 B1 7/2015 Podhajny
9,078,488 B1 7/2015 Podhajny et al.
9,084,449 B2 7/2015 Huffman et al.
9,095,187 B2 8/2015 Molyneux et al.
9,132,601 B2 9/2015 Beye et al.
9,139,938 B2 9/2015 Podhajny et al.
9,145,629 B2 9/2015 Podhajny
9,150,986 B2 10/2015 Shaffer et al.
9,192,204 B1 11/2015 Klug et al.
9,226,540 B2 1/2016 Podhajny et al.
9,297,097 B2 3/2016 Turner
9,301,567 B2 4/2016 Roulo et al.
9,339,076 B2 5/2016 Podhajny et al.
9,353,469 B2 5/2016 Meir et al.
9,357,813 B2 6/2016 Lyden
9,365,959 B2 6/2016 Turner
9,375,046 B2 6/2016 Meir
9,398,784 B2 7/2016 Baudouin et al.
9,498,023 B2 11/2016 Craig
9,723,890 B2 8/2017 Long et al.
9,839,255 B2 12/2017 Adami et al.
10,070,671 B2 9/2018 Moran
10,098,412 B2 10/2018 Hoffer et al.
2001/0016993 A1 8/2001 Cagner
2001/0024709 A1 9/2001 Yoneda et al.
2001/0032399 A1 10/2001 Litchfield et al.
2001/0054240 A1 12/2001 Bordin et al.
2001/0055684 A1 12/2001 Davis et al.
2002/0000002 A1 1/2002 Hatch et al.
2002/0002780 A1 1/2002 Barthelemy et al.
2002/0007570 A1 1/2002 Girard
2002/0012784 A1 1/2002 Norton et al.
2002/0026730 A1 3/2002 Whatley
2002/0035796 A1 3/2002 Knoche et al.
2002/0053148 A1 5/2002 Haimerl et al.
2002/0078599 A1* 6/2002 Delgorgue ..... A43B 23/0235 36/98
2002/0092199 A1 7/2002 Fish et al.
2002/0148142 A1 10/2002 Oorei et al.
2002/0148258 A1 10/2002 Cole et al.
2002/0152638 A1 10/2002 Safdeye et al.
2002/0152776 A1 10/2002 Didier Laurent
2002/0157281 A1 10/2002 Safdeye et al.
2003/0009908 A1 1/2003 Sheets et al.
2003/0009919 A1 1/2003 Stein
2003/0033837 A1 2/2003 Higgins
2003/0039882 A1 2/2003 Wruck et al.
2003/0051372 A1 3/2003 Lyden
2003/0069807 A1 4/2003 Lyden
2003/0079374 A1 5/2003 Belley et al.
2003/0097766 A1 5/2003 Morgan
2003/0106171 A1 6/2003 Issler
2003/0121179 A1 7/2003 Chen et al.
2003/0126762 A1 7/2003 Tseng
2003/0131499 A1 7/2003 Silverman
2003/0191427 A1 10/2003 Jay et al.
2003/0192351 A1 10/2003 Meckley et al.
2003/0226280 A1 12/2003 Paratore et al.
2003/0227105 A1 12/2003 Paratore et al.
2004/0009731 A1 1/2004 Rabinowicz
2004/0045955 A1 3/2004 Rock et al.
2004/0083622 A1 5/2004 Mizrahi et al.
2004/0099016 A1 5/2004 Shepherd
2004/0107603 A1 6/2004 Wei et al.
2004/0111920 A1 6/2004 Cretinon
2004/0111921 A1 6/2004 Lenormand
2004/0118018 A1* 6/2004 Dua ..... A43B 1/14 36/45
2004/0139628 A1 7/2004 Wiener et al.
2004/0139629 A1 7/2004 Wiener et al.
2004/0143995 A1 7/2004 Mcclelland
2004/0163280 A1 8/2004 Morris et al.
2004/0181972 A1 9/2004 Csorba
2004/0198178 A1 10/2004 Mitchell et al.
2004/0205982 A1 10/2004 Challe
2004/0216332 A1 11/2004 Wilson et al.
2004/0221783 A1 11/2004 Niimi
2004/0226113 A1 11/2004 Wright et al.

(56) References Cited

U.S. PATENT DOCUMENTS

2004/0250446 A1* 12/2004 Greene ..... A43B 13/10 36/25 R
2004/0255486 A1 12/2004 Pawlus et al.
2004/0261467 A1 12/2004 Chapman
2005/0016023 A1* 1/2005 Burris ..... A43B 7/08 36/45
2005/0028405 A1 2/2005 Wilson et al.
2005/0055843 A1 3/2005 Morlacchi
2005/0081402 A1 4/2005 Orei et al.
2005/0091725 A1 5/2005 Alley et al.
2005/0102863 A1 5/2005 Hannon et al.
2005/0108898 A1 5/2005 Jeppesen et al.
2005/0115281 A1 6/2005 Mitchell et al.
2005/0115284 A1 6/2005 Dua
2005/0127057 A1 6/2005 Rock et al.
2005/0138845 A1 6/2005 Haimerl et al.
2005/0155137 A1 7/2005 Berger
2005/0160626 A1 7/2005 Townsend
2005/0166426 A1 8/2005 Donnadieu et al.
2005/0166427 A1 8/2005 Greene et al.
2005/0193592 A1 9/2005 Dua et al.
2005/0208857 A1 9/2005 Baron et al.
2005/0208860 A1 9/2005 Baron et al.
2005/0210704 A1 9/2005 Connolly
2005/0268497 A1 12/2005 Alfaro et al.
2005/0273988 A1 12/2005 Christy et al.
2005/0284000 A1 12/2005 Kerns
2006/0006168 A1 1/2006 Rock et al.
2006/0010717 A1 1/2006 Finkelstein
2006/0016099 A1 1/2006 Marco et al.
2006/0021258 A1 2/2006 Beck
2006/0048413 A1* 3/2006 Sokolowski ..... B32B 27/12 36/45
2006/0059715 A1 3/2006 Aveni
2006/0059716 A1 3/2006 Yamashita et al.
2006/0112594 A1 6/2006 Kilgore
2006/0117607 A1 6/2006 Pare et al.
2006/0130359 A1 6/2006 Dua et al.
2006/0162187 A1 7/2006 Byrnes et al.
2006/0179549 A1 8/2006 Huggins et al.
2006/0243000 A1 11/2006 Turlan et al.
2007/0000027 A1 1/2007 Ganzoni et al.
2007/0003728 A1 1/2007 Hannon et al.
2007/0022627 A1 2/2007 Sokolowski et al.
2007/0074334 A1 4/2007 Steel et al.
2007/0144039 A1 6/2007 Fliri
2007/0180730 A1 8/2007 Greene et al.
2007/0204482 A1 9/2007 Gibson-Collinson
2007/0234593 A1 10/2007 Beck et al.
2007/0271817 A1 11/2007 Ellis et al.
2008/0000108 A1 1/2008 Ellis et al.
2008/0010860 A1 1/2008 Gyr
2008/0017294 A1 1/2008 Bailey et al.
2008/0022554 A1 1/2008 Meschter et al.
2008/0032580 A1 2/2008 Fukuoka et al.
2008/0066499 A1 3/2008 Andrieu et al.
2008/0078102 A1 4/2008 Kilgore et al.
2008/0110048 A1 5/2008 Dua et al.
2008/0110049 A1 5/2008 Sokolowski et al.
2008/0189830 A1 8/2008 Egglesfield et al.
2008/0235877 A1 10/2008 Murray et al.
2008/0250668 A1 10/2008 Marvin et al.
2008/0263893 A1 10/2008 Hernandez et al.
2008/0295230 A1 12/2008 Wright et al.
2008/0313939 A1 12/2008 Ardill et al.
2009/0007457 A1 1/2009 Skirrow
2009/0014424 A1* 1/2009 Meschter ..... A43B 23/0255 219/121.69
2009/0068908 A1 3/2009 Hinchcliff et al.
2009/0071036 A1 3/2009 Hooper et al.
2009/0107012 A1 4/2009 Cheney et al.
2009/0126225 A1 5/2009 Jarvis
2009/0126229 A1 5/2009 Fuerst et al.
2009/0134145 A1 5/2009 Rock et al.
2009/0172971 A1 7/2009 Peikert et al.
2009/0241374 A1 10/2009 Sato et al.
2009/0297794 A1 12/2009 Lin
2009/0300823 A1 12/2009 Connaghan et al.
2010/0018075 A1 1/2010 Meschter et al.
2010/0037483 A1 2/2010 Meschter et al.
2010/0043253 A1 2/2010 Dojan et al.
2010/0051132 A1 3/2010 Glenn et al.
2010/0064453 A1 3/2010 Haimerl
2010/0077634 A1 4/2010 Bell
2010/0107346 A1 5/2010 Aveni et al.
2010/0107443 A1 5/2010 Aveni et al.
2010/0154256 A1 6/2010 Dua
2010/0162590 A1 7/2010 Bönigk et al.
2010/0170651 A1 7/2010 Scherb et al.
2010/0175276 A1 7/2010 Dojan et al.
2010/0199406 A1* 8/2010 Dua ..... B29C 66/30326 2/115
2010/0229429 A1 9/2010 Longuet
2010/0269372 A1 10/2010 Dua et al.
2010/0299962 A1 12/2010 Fliri
2011/0030244 A1 2/2011 Motawi et al.
2011/0061148 A1 3/2011 Egozi
2011/0061149 A1 3/2011 Polacco et al.
2011/0061265 A1 3/2011 Lyden
2011/0078921 A1 4/2011 Greene et al.
2011/0088282 A1 4/2011 Dojan et al.
2011/0088285 A1 4/2011 Dojan et al.
2011/0099845 A1 5/2011 Miller
2011/0107622 A1* 5/2011 Schwirian ..... A43B 13/026 36/30 A
2011/0154689 A1 6/2011 Chung
2011/0154693 A1 6/2011 Oberschneider et al.
2011/0179677 A1 7/2011 Jessiman et al.
2011/0192059 A1 8/2011 Spanks et al.
2011/0197472 A1 8/2011 Yamada
2011/0219643 A1 9/2011 Tai et al.
2011/0247239 A1 10/2011 Berend et al.
2011/0283567 A1 11/2011 Yin
2011/0302727 A1 12/2011 Sokolowski et al.
2011/0302810 A1 12/2011 Borel et al.
2011/0308108 A1 12/2011 Berns et al.
2011/0308110 A1 12/2011 Berns et al.
2012/0023686 A1 2/2012 Huffa et al.
2012/0023778 A1 2/2012 Dojan et al.
2012/0055044 A1 3/2012 Dojan et al.
2012/0090077 A1 4/2012 Brown et al.
2012/0114883 A1 5/2012 Kapur et al.
2012/0117823 A1 5/2012 Meschter et al.
2012/0124863 A1 5/2012 Aveni et al.
2012/0144698 A1 6/2012 McDowell
2012/0144699 A1 6/2012 Eggert et al.
2012/0159813 A1 6/2012 Dua et al.
2012/0180195 A1 7/2012 Shull et al.
2012/0198730 A1* 8/2012 Burch ..... A43B 23/0215 36/30 R
2012/0199277 A1* 8/2012 Loveder ..... A43B 1/0027 156/242
2012/0204448 A1 8/2012 Bracken
2012/0216423 A1 8/2012 Lyden
2012/0216430 A1 8/2012 Stöhr et al.
2012/0233878 A1 9/2012 Hazenberg et al.
2012/0233879 A1 9/2012 Dojan et al.
2012/0233880 A1 9/2012 Chao et al.
2012/0233882 A1 9/2012 Huffa et al.
2012/0233883 A1 9/2012 Spencer et al.
2012/0233884 A1 9/2012 Greene
2012/0233885 A1 9/2012 Shaffer et al.
2012/0233886 A1 9/2012 Madore et al.
2012/0233887 A1 9/2012 Baker et al.
2012/0233888 A1 9/2012 Baker et al.
2012/0234051 A1 9/2012 Huffa
2012/0234052 A1* 9/2012 Huffa ..... A43B 23/042 66/64
2012/0234111 A1 9/2012 Molyneux et al.
2012/0234467 A1 9/2012 Rapaport et al.
2012/0235322 A1 9/2012 Greene et al.
2012/0238376 A1 9/2012 Knight et al.
2012/0238910 A1 9/2012 Nordstrom
2012/0240429 A1 9/2012 Sokolowski et al.

(56) References Cited

U.S. PATENT DOCUMENTS

2012/0246973 A1* 10/2012 Dua ..... A43B 23/0275 36/83
2012/0255201 A1 10/2012 Little
2012/0272548 A1 11/2012 Downard et al.
2012/0276339 A1 11/2012 Pearce et al.
2012/0279260 A1* 11/2012 Dua ..... D04B 1/16 66/171
2012/0285039 A1 11/2012 Lazaris et al.
2012/0285043 A1 11/2012 Dua et al.
2012/0297557 A1 11/2012 Koo et al.
2012/0297642 A1 11/2012 Schaefer et al.
2012/0297643 A1 11/2012 Shaffer et al.
2012/0297645 A1 11/2012 Berbert et al.
2012/0318026 A1 12/2012 Dua et al.
2013/0031801 A1 2/2013 Hatfield et al.
2013/0036629 A1 2/2013 Bramani et al.
2013/0047471 A1 2/2013 Liang
2013/0055590 A1 3/2013 Mokos
2013/0061405 A1 3/2013 Haimerl
2013/0074364 A1 3/2013 Lim
2013/0091741 A1 4/2013 Frank et al.
2013/0118031 A1 5/2013 Chenciner et al.
2013/0139407 A1 6/2013 Brongers et al.
2013/0145652 A1 6/2013 Podhajny et al.
2013/0152424 A1 6/2013 Dojar
2013/0160323 A1 6/2013 Hsiao et al.
2013/0174449 A1 7/2013 Koyess et al.
2013/0219749 A1 8/2013 Dojan et al.
2013/0232820 A1 9/2013 Bramani et al.
2013/0239438 A1 9/2013 Dua et al.
2013/0255103 A1* 10/2013 Dua ..... B29C 66/244 36/87
2013/0260104 A1* 10/2013 Dua ..... B29C 65/72 428/175
2013/0260629 A1 10/2013 Dua et al.
2013/0269209 A1 10/2013 Lang et al.
2014/0068968 A1 3/2014 Podhajny et al.
2014/0082965 A1 3/2014 Greene et al.
2014/0101824 A1 4/2014 Spanks et al.
2014/0123409 A1 5/2014 Huffa et al.
2014/0130373 A1 5/2014 Baines et al.
2014/0130374 A1 5/2014 Minami et al.
2014/0130375 A1 5/2014 Baines et al.
2014/0130376 A1 5/2014 Fahmi et al.
2014/0137433 A1 5/2014 Craig et al.
2014/0137434 A1 5/2014 Craig
2014/0144190 A1 5/2014 Tatler et al.
2014/0150292 A1 6/2014 Podhajny et al.
2014/0150295 A1 6/2014 Dua et al.
2014/0150296 A1 6/2014 Dua et al.
2014/0157831 A1 6/2014 Huffa et al.
2014/0196314 A1 7/2014 Beye et al.
2014/0209233 A1 7/2014 Dua et al.
2014/0223777 A1 8/2014 Whiteman et al.
2014/0237855 A1 8/2014 Podhajny et al.
2014/0237856 A1 8/2014 Podhajny et al.
2014/0238082 A1 8/2014 Meir et al.
2014/0238083 A1 8/2014 Meir et al.
2014/0245544 A1 9/2014 Huffa et al.
2014/0245546 A1 9/2014 Huffa et al.
2014/0245547 A1 9/2014 Molyneux et al.
2014/0245633 A1 9/2014 Podhajny et al.
2014/0245634 A1 9/2014 Podhajny et al.
2014/0245636 A1 9/2014 Seamarks et al.
2014/0245637 A1 9/2014 Fahmi et al.
2014/0245639 A1 9/2014 Dua et al.
2014/0245643 A1 9/2014 Huffa et al.
2014/0310983 A1 10/2014 Tamm et al.
2014/0310984 A1 10/2014 Tamm et al.
2014/0310985 A1 10/2014 Tran et al.
2014/0310986 A1 10/2014 Tamm et al.
2014/0338226 A1 11/2014 Zavala
2014/0352082 A1 12/2014 Shaffer et al.
2014/0352173 A1 12/2014 Bell et al.
2015/0013080 A1 1/2015 Thomas et al.
2015/0013188 A1 1/2015 Baines et al.
2015/0013394 A1 1/2015 Huffa
2015/0013395 A1 1/2015 Huffa
2015/0040431 A1 2/2015 Molyneux et al.
2015/0047225 A1 2/2015 Dealey et al.
2015/0059209 A1 3/2015 Dekovic et al.
2015/0059211 A1 3/2015 Podhajny et al.
2015/0075031 A1 3/2015 Podhajny et al.
2015/0101212 A1 4/2015 Dekovic et al.
2015/0143716 A1 5/2015 Savage et al.
2015/0143720 A1 5/2015 Avar et al.
2015/0216254 A1 8/2015 Podhajny et al.
2015/0216255 A1 8/2015 Podhajny
2015/0216257 A1 8/2015 Meir et al.
2015/0223552 A1 8/2015 Love et al.
2015/0250256 A1 9/2015 Podhajny et al.
2015/0264995 A1 9/2015 Hilderbrand
2015/0272261 A1 10/2015 Huffman et al.
2015/0342285 A1 12/2015 Bell et al.
2015/0359290 A1 12/2015 Podhajny et al.
2015/0366293 A1 12/2015 Clarkson et al.
2016/0029736 A1 2/2016 Meir
2016/0088894 A1 3/2016 Podhajny et al.
2016/0088899 A1 3/2016 Klug et al.
2016/0090670 A1 3/2016 Meir
2016/0095377 A1 4/2016 Tamm
2016/0135543 A1 5/2016 Anceresi et al.
2016/0198797 A1 7/2016 Ikenaka
2016/0206039 A1 7/2016 Cross et al.
2016/0206040 A1 7/2016 Cross et al.
2016/0206042 A1 7/2016 Cross et al.
2016/0206046 A1 7/2016 Cross et al.
2016/0278481 A1 9/2016 Le et al.
2016/0295971 A1 10/2016 Arnese et al.
2017/0156434 A1 6/2017 Tamm et al.
2017/0311650 A1 11/2017 Hupperets et al.
2018/0064201 A1 3/2018 Tran et al.
2018/0092432 A1 4/2018 Hoffer et al.
2019/0082774 A1 3/2019 Tamm et al.
2019/0082775 A1 3/2019 Tamm et al.

FOREIGN PATENT DOCUMENTS

CA 2387640 4/2003
CN 1429512 3/1936
CN 2044806 9/1989
CN 1067566 A 1/1993
CN 2187379 1/1995
CN 2438730 7/2001
CN 1392833 1/2003
CN 1411762 4/2003
CN 1155597 6/2004
CN 1960650 5/2007
CN 101316526 12/2008
CN 201356120 12/2009
CN 102939023 2/2013
CN 104413996 3/2015
DE 71153 A 4/1893
DE 627878 7/1936
DE 870963 3/1953
DE 1736512 12/1956
DE 1785183 U 3/1959
DE 1084173 B1 6/1960
DE 1910713 7/1970
DE 1785183 A1 11/1971
DE 2044031 A1 3/1972
DE 1685690 A1 1/1973
DE 2162456 6/1973
DE 2305693 A1 8/1973
DE 2505537 8/1976
DE 2801984 7/1979
DE 3820094 12/1989
DE 4400739 7/1995
DE 68922952 11/1995
DE 4419802 12/1995
DE 4419803 12/1995
DE 4441555 6/1996
DE 19738433 A1 4/1997
DE 19629317 10/1997

(56) References Cited

FOREIGN PATENT DOCUMENTS

| | | | |
|---|---|---|---|
| DE | 19728848 | A1 | 1/1999 |
| DE | 4443002 | | 2/1999 |
| DE | 19855542 | A1 | 6/2000 |
| DE | 19910785 | A1 | 9/2000 |
| DE | 10022254 | | 11/2001 |
| DE | 10037728 | | 2/2002 |
| DE | 10145073 | | 4/2003 |
| DE | 10228143 | A1 | 11/2003 |
| DE | 3903242 | | 7/2004 |
| DE | 4138836 | | 7/2004 |
| DE | 19910785 | B4 | 12/2004 |
| DE | 602004000536 | | 12/2006 |
| DE | 102005030651 | A1 | 1/2007 |
| DE | 10316979 | | 2/2007 |
| DE | 60031821 | | 9/2007 |
| DE | 102006009974 | | 9/2007 |
| DE | 102006022494 | | 11/2007 |
| DE | 202007011165 | | 1/2008 |
| DE | 202009010225 | | 2/2010 |
| DE | 202009011928 | | 2/2010 |
| DE | 102009018942 | | 11/2010 |
| DE | 102009028627 | A1 | 3/2011 |
| DE | 102010037585 | | 3/2012 |
| DE | 102011055154 | | 5/2012 |
| DE | 202012100938 | | 5/2012 |
| DE | 202007019490 | U1 | 12/2012 |
| DE | 202009018763 | U1 | 2/2013 |
| DE | 202009018765 | U1 | 2/2013 |
| DE | 102012206062 | | 10/2013 |
| DE | 202012013113 | | 11/2014 |
| DE | 202012013114 | | 11/2014 |
| DE | 202012013118 | | 11/2014 |
| DE | 202012013119 | | 11/2014 |
| DE | 202012013120 | | 11/2014 |
| EP | 0037629 | | 10/1981 |
| EP | 0045372 | A | 2/1982 |
| EP | 0105773 | | 4/1984 |
| EP | 279950 | | 8/1988 |
| EP | 0383685 | A1 | 8/1990 |
| EP | 0384059 | | 8/1990 |
| EP | 0446583 | A | 9/1991 |
| EP | 0448714 | B1 | 10/1991 |
| EP | 0472743 | | 3/1992 |
| EP | 0499710 | A2 | 8/1992 |
| EP | 0508712 | A1 | 10/1992 |
| EP | 0664092 | | 7/1995 |
| EP | 0728860 | A1 | 8/1996 |
| EP | 0758693 | A1 | 2/1997 |
| EP | 0845553 | A1 | 6/1998 |
| EP | 0864681 | A2 | 9/1998 |
| EP | 898002 | | 2/1999 |
| EP | 0959704 | | 12/1999 |
| EP | 1004829 | A1 | 5/2000 |
| EP | 1031656 | A1 | 8/2000 |
| EP | 1091033 | A2 | 4/2001 |
| EP | 0758693 | B1 | 10/2001 |
| EP | 0833000 | B1 | 3/2002 |
| EP | 0733732 | B1 | 7/2002 |
| EP | 1219191 | | 7/2002 |
| EP | 1233091 | A1 | 8/2002 |
| EP | 1273693 | A2 | 1/2003 |
| EP | 1275761 | A1 | 1/2003 |
| EP | 1437057 | A1 | 7/2004 |
| EP | 1148161 | B1 | 4/2005 |
| EP | 1563752 | | 8/2005 |
| EP | 1602762 | | 12/2005 |
| EP | 1352118 | B1 | 10/2006 |
| EP | 1972706 | | 9/2008 |
| EP | 2023762 | A1 | 2/2009 |
| EP | 2079336 | A1 | 7/2009 |
| EP | 2088887 | A1 | 8/2009 |
| EP | 1571938 | B1 | 11/2009 |
| EP | 2248434 | | 11/2010 |
| EP | 2378910 | A1 | 10/2011 |
| EP | 1919321 | B1 | 8/2012 |
| EP | 2485619 | A1 | 8/2012 |
| EP | 2520188 | A1 | 11/2012 |
| EP | 1571938 | B3 | 5/2013 |
| EP | 2088887 | | 5/2013 |
| EP | 2591694 | | 5/2013 |
| EP | 2649898 | | 10/2013 |
| EP | 2716177 | | 7/2014 |
| EP | 2803283 | | 1/2015 |
| EP | 1773149 | B1 | 6/2015 |
| EP | 2904920 | | 8/2015 |
| EP | 2952346 | | 12/2015 |
| EP | 2977205 | | 1/2016 |
| EP | 2686467 | | 4/2016 |
| EP | 2713793 | | 6/2016 |
| EP | 2505092 | | 8/2016 |
| FR | 858875 | | 12/1940 |
| FR | 862088 | | 2/1941 |
| FR | 2171172 | A1 | 9/1973 |
| FR | 2491739 | | 9/1982 |
| FR | 2506576 | | 12/1984 |
| FR | 2504786 | | 1/1986 |
| FR | 2648684 | | 12/1990 |
| FR | 2776485 | | 4/2000 |
| FR | 2780619 | | 9/2000 |
| FR | 2784550 | | 1/2001 |
| FR | 2848807 | | 7/2013 |
| GB | 109091 | | 8/1917 |
| GB | 273968 | | 7/1927 |
| GB | 323457 | | 1/1930 |
| GB | 413279 | | 7/1934 |
| GB | 538865 | A | 8/1941 |
| GB | 674835 | | 7/1952 |
| GB | 761519 | A | 11/1956 |
| GB | 782562 | | 9/1957 |
| GB | 832518 | | 4/1960 |
| GB | 1102447 | | 2/1968 |
| GB | 1219433 | A | 1/1971 |
| GB | 1328693 | | 8/1973 |
| GB | 1539886 | | 2/1979 |
| GB | 2018837 | | 10/1979 |
| GB | 1572493 | | 7/1980 |
| GB | 1581999 | | 12/1980 |
| GB | 1603487 | A | 11/1981 |
| GB | 2044073 | | 3/1983 |
| GB | 2131677 | | 6/1984 |
| GB | 2133273 | | 7/1984 |
| GB | 2214939 | B | 4/1992 |
| GB | 317184 | | 8/2003 |
| GB | 413017 | | 7/2004 |
| GB | 2408190 | | 5/2005 |
| JP | S39-16845 | | 6/1939 |
| JP | S59-166706 | U | 11/1984 |
| JP | S63-057909 | U | 4/1988 |
| JP | S6357909 | U | 4/1988 |
| JP | 2079336 | | 3/1990 |
| JP | H02-116806 | U | 9/1990 |
| JP | H03-003203 | U | 1/1991 |
| JP | H033203 | U | 1/1991 |
| JP | H05-176804 | A | 7/1993 |
| JP | H06-008722 | Y2 | 3/1994 |
| JP | H068722 | Y2 | 3/1994 |
| JP | H6-113905 | | 4/1994 |
| JP | H06-154001 | A | 6/1994 |
| JP | H06-248501 | A | 9/1994 |
| JP | H06-296507 | A | 10/1994 |
| JP | 3005269 | U | 12/1994 |
| JP | H0759604 | | 3/1995 |
| JP | H0725804 | U | 5/1995 |
| JP | H07-148004 | A | 6/1995 |
| JP | H07-246101 | A | 9/1995 |
| JP | H8109553 | A | 4/1996 |
| JP | H09-047302 | A | 2/1997 |
| JP | H09-238701 | A | 9/1997 |
| JP | H10-000103 | A | 1/1998 |
| JP | H10-130991 | A | 5/1998 |
| JP | H10-155504 | A | 6/1998 |
| JP | H10-179209 | A | 7/1998 |
| JP | H03-064834 | U | 5/1999 |
| JP | H11-229253 | A | 8/1999 |

(56) References Cited

FOREIGN PATENT DOCUMENTS

| | | | |
|---|---|---|---|
| JP | H11302943 | | 11/1999 |
| JP | 2000-015732 | A | 1/2000 |
| JP | 2000-279201 | A | 10/2000 |
| JP | 2001017206 | | 1/2001 |
| JP | 2001-104091 | A | 4/2001 |
| JP | 2001-164407 | A | 6/2001 |
| JP | 2001-164444 | A | 6/2001 |
| JP | 2002-088512 | A | 3/2002 |
| JP | 2002146654 | | 5/2002 |
| JP | 2004-230151 | A | 8/2004 |
| JP | 2004-283586 | A | 10/2004 |
| JP | 2006-150064 | A | 6/2006 |
| JP | 2006-249586 | A | 9/2006 |
| JP | 3865307 | B2 | 1/2007 |
| JP | 2007-204864 | A | 8/2007 |
| JP | 2007-236612 | A | 9/2007 |
| JP | 2007-239151 | A | 9/2007 |
| JP | 4376792 | B2 | 12/2009 |
| JP | 2010-030289 | A | 2/2010 |
| JP | 2010-163712 | A | 7/2010 |
| JP | 2010-275649 | A | 12/2010 |
| JP | 2011-256506 | A | 12/2011 |
| JP | 2012-500071 | A | 1/2012 |
| JP | 4851688 | B2 | 1/2012 |
| JP | 2012062615 | | 3/2012 |
| JP | 2012-512698 | A | 6/2012 |
| JP | 2012-522551 | A | 9/2012 |
| JP | 2012533404 | | 12/2012 |
| JP | 2013-151783 | A | 8/2013 |
| JP | 2015-025223 | A | 2/2015 |
| NL | 7304678 | | 10/1974 |
| NL | 7505389 | | 11/1975 |
| WO | 90/03744 | | 4/1990 |
| WO | 9221806 | | 12/1992 |
| WO | WO 9746127 | A1 | 12/1997 |
| WO | 9843506 | | 10/1998 |
| WO | 9914415 | | 3/1999 |
| WO | 9943229 | | 9/1999 |
| WO | 032861 | | 6/2000 |
| WO | 0033694 | | 6/2000 |
| WO | 0112003 | | 2/2001 |
| WO | 0112004 | | 2/2001 |
| WO | 2002072325 | | 3/2002 |
| WO | 0231247 | | 4/2002 |
| WO | 0241721 | | 5/2002 |
| WO | 2004064558 | | 8/2004 |
| WO | 2004066770 | | 8/2004 |
| WO | 2004098333 | | 11/2004 |
| WO | 2005004656 | | 1/2005 |
| WO | 2005025841 | A1 | 3/2005 |
| WO | 2005055754 | | 6/2005 |
| WO | 2005074737 | | 8/2005 |
| WO | 2007005459 | | 1/2007 |
| WO | 2009143000 | | 11/2009 |
| WO | 2010020391 | | 2/2010 |
| WO | 2010090923 | | 8/2010 |
| WO | WO 2011/108954 | A1 | 9/2011 |
| WO | 2011138639 | | 11/2011 |
| WO | 2012018731 | | 2/2012 |
| WO | 2012125473 | | 9/2012 |
| WO | 2012125483 | | 9/2012 |
| WO | 2012125490 | | 9/2012 |
| WO | 2012138488 | | 10/2012 |
| WO | 12151408 | | 11/2012 |
| WO | 12166602 | | 12/2012 |
| WO | 12166607 | | 12/2012 |
| WO | WO 2013086145 | A1 | 6/2013 |
| WO | 2013126314 | | 8/2013 |
| WO | 2013192363 | | 12/2013 |
| WO | 2014078152 | | 5/2014 |
| WO | 2014078158 | | 5/2014 |
| WO | 2014078160 | | 5/2014 |
| WO | 2014078161 | | 5/2014 |
| WO | 2014081680 | | 5/2014 |
| WO | 2014085205 | | 6/2014 |
| WO | 2014085206 | | 6/2014 |
| WO | 2014113352 | | 7/2014 |
| WO | 2014134236 | | 9/2014 |
| WO | 2014134237 | | 9/2014 |
| WO | 2014134239 | | 9/2014 |
| WO | 2014134242 | | 9/2014 |
| WO | 2014134247 | | 9/2014 |
| WO | 2014137825 | | 9/2014 |
| WO | 2014134244 | | 11/2014 |
| WO | 2015030914 | | 3/2015 |
| WO | 2015076893 | | 5/2015 |
| WO | WO 2015134648 | A1 | 9/2015 |
| WO | 2016018904 | | 2/2016 |

OTHER PUBLICATIONS

Spencer, David J., Knitting Technology, Woodhead Publishing Limited, 1989 and 2001, 413 pages.

Excerpt of Hannelore Eberle, Clothing Technology, dated 2002, 3 pages.

Horrocks Richard, et al., Technical Fabric Structures—2. Knitted Fabrics, Handbook of Technical Textiles, Woodhead Publishng, 2000, 5 pages.

Karl Mayer GmBH, Duolastic—an elastic fabric sets new standards, HKS 1 MSU E-Magazine, Aug. 4, 1989, 8 pages.

Karl Mayer GmBH, Compendium Warp Knitting, Magazine, Aug. 1, 1978, 8 pages.

Karl Mayer GmBH, Multibar Jacquard Raschel Machine for Lace, Net Curtains and Patterned Elastic Products, Magazine, Aug. 4, 1978, 6 pages.

Karl Mayer GmBH, MRSS 42 SU: for producing the finest lces with ground in 22 dtex monofilaments, Magazine, Aug. 4, 1988, 3 pages.

Karl Mayer GmBH, Jacquard Rashchel machine for the Production of Curtains, Magazine, Jan. 12, 1996, 4 pages.

Karl Mayer GmBH, Fabric Pictures, Internet, undated, 7 pages.

Declaration and Curriculum Vitae of Dr. Edward C. Frederick, filed Nov. 28, 2012 as Exhibit 1001 in IPR2013-00067, 178 pages.

File History for U.S. Pat. No. 7,347,011, filed Nov. 28, 2012, as Exhibit 1003 in IPR2013-00067, 202 pages.

IDS under 37 C.F.R. 1.501, filed Nov. 28, 2012, as Exhibit 1004 in IPR2013-00067, 2 pages.

Ebrlle, H, et al., Clothing Technology, Sixth German Edition and Third English Edition, Veriag Europa-Lehrmittel, Nourney, Vollmer GmbH & Co., D-42781 Haa-Guriten, ISBN 3-8085-6223-4, 2002, filed Nov. 28, 2012, as Exhibit 1013 in IPR2013-00067, 3 pages.

Notice of Filing Date Accorded to Petition and Time for Filing Patent Owner Preliminary Response in IPR2013-00067, Dec. 4, 2012 8 pages.

Petitioner Power of Attorney dated Nov. 22, 2012 and filed Nov. 28, 2012 in IPR2013-00067, 2 pages.

Revised Petition for Inter Partes Review Under 35 U.S.C. §§ 311-319 and 37 C.F.R. § 42.100 et seq filed Dec. 10, 2012 in IPR2013-00067, 64 pages.

List of Related Matters filed Dec. 14, 2012 in IPR2013-00067.

Mandatory Notice Information filed Jan. 25, 2013 IPR2013-00067.

Submission of Power of Attorney filed Jan. 25, 2013 in IPR2013-00067.

Mandatory Notice Information filed Feb. 28, 2013 in IPR2013-00067.

Patent Owner's Preliminary Response to Petition filed Feb. 28, 2013 in IPR2013-00067.

Decision Institution of Inter Partes Review 37 C.F.R. § 42.108, entered May 17, 2013 in IPR2013-00067.

Scheduling Order dated May 17, 2013 in IPR2013-00067.

International Search Report and Written Opinion mailed May 19, 2005 in related PCT Application No. PCT/US2005/004776.

Page 1 of Lyden Letter dated Apr. 21, 2010—redacted.

Office Action in Chinese Patent Application No. 2005800066703 and English Translation dated Jul. 27, 2007.

Office Action in Chinese Patent Application No. 2005800066703 and English Translation dated Feb. 15, 2008.

Office Action in Chinese Patent Application No. 2005800066703 and English Translation dated Jun. 13, 2008.

(56) References Cited

OTHER PUBLICATIONS

Office Action in Chinese Patent Application No. 2005800066703 and English Translation dated Aug. 21, 2009.
Office Action in Chinese Patent Application No. 2009101783949 and English Translation dated May 13, 2011.
Notice of Stipulation in entered Jun. 14, 2013 in IPR2013-00067.
Patent Owner's List of Proposed Motions filed Jun. 14, 2013 in IPR2013-00067.
Order Conduct of the Proceeding entered Jun. 19, 2013 in IPR2013-00067.
Petitioner's Power of Attorney filed Jul. 11, 2013 in IPR2013-00067.
Patent Owner's Notice of Cross Examination of Edward C. Frederick filed Jul. 17, 2013 in IPR2013-00067.
Order Conduct of the Proceeding entered Aug. 2, 2013 in IPR2013-00067.
Patent Owner's Motion to Amend Patent 7,347,011 filed Aug. 19, 2013 in IPR2013-00067.
Patent Owner Exhibit List filed Aug. 19, 2013 in IPR2013-00067.
Patent Owner Corrected Certificate of Service filed Aug. 19, 2013 in IPR2013-00067.
Patent Owner Exhibit List filed Aug. 29, 2013 in IPR2013-00067.
Petitioner's Amended Notice of Cross Examination of Raymond Tonkel filed Nov. 1, 2013 in IPR2013-00067.
Petitioner's Opposition to Patent Owner's Motion to Amend filed Nov. 12, 2013 in IPR2013-00067.
Petitioner's Exhibit List filed Nov. 12, 2013 in IPR2013-00067.
Supplemental Declaration Edward C. Frederick, filed Nov. 12, 2013 as Exhibit 1023 in IPR2013-00067, 18 pages.
Hunter, Billy, viewpoint: Nike Flyknit Quantum Leap for Flat Knitting, www.knittingindustry.com. Jul. 26, 2012, as Exhibit 1024 in IPR2013-00067 filed Nov. 12, 2013, 5 pages.
Hunter, Billy, viewpoint: Nike Flyknit Ready, Steady, Go, www.knittingindustry.com, Jul. 31, 2012, as Exhibit 1025 in IPR2013-00067 filed Nov. 12, 2013, 5 pages.
IDS under 37 C.F.R. 1.501, filed Nov. 12, 2013, as Exhibit 1026 in IPR2013-00067, 2 pages.
Declaration Edward C. Frederick with note, filed Aug. 19, 2013 as Exhibit 2002 in IPR2013-00067, 18 pages.
Exhibit 2003, U.S. Pat. No. 4,354,318 in IPR2013-00067 filed Aug. 19, 2013.
R. Shishoo, Chapter 16 of Textiles in Sport, filed Nov. 28, 2012 as Exhibit 2004 in IPR2013-00067.
Exhibit 2006, U.S. Pat. No. 2,147,197 with markings in IPR2013-00067 filed Aug. 19, 2013.
Exhibit 2008, Decision on Appeal in Reexam U.S. Appl. No. 95/001,320 in IPR2013-00067 filed Aug. 19, 2013.
Exhibit 2009, Edward Frederick Deposition Transcript dated Jul. 23, 2013 as exhibit 2009 in IPR2013-00067 filed Aug. 19, 2013.
Exhibit 2010, Declaration of Raymond Tonkel as exhibit 2010 in IPR2013-00067 filed Aug. 19, 2013.
Exhibit 2011, Excerpts from Man-Made Fiber and Textile Dictionary as exhibit 2011 in IPR2013-00067 filed Aug. 19, 2013.
Exhibit 2012, Random House Webster Dictionary Excerpts as exhibit 2012 in IPR2013-00067 filed Aug. 19, 2013.
Exhibit 2013, Errata Sheet from Edward Frederick Deposition dated Augsust 23, 2013 as exhibit 2013 in IPR2013-00067 filed Aug. 29, 2013.
European Patent Application No. 13161357.2 , "Extended European Search Report" mailed Aug. 5, 2013, 6 pages.
Chinese Patent Application No. 201310128387.4, Office Action mailed Mar. 27, 2015, 7 pages. (No English translation available. Summary of Office Action provided in accompanying Transmittal Letter.).
Nike's Motion to Amend filed in IPR2013-00067 on Aug. 19, 2013, 19 pages.
Exhibit 2007, U.S. Pat. No. 7,347,011 with markings filed in IPR2013-00067 on Aug. 19, 2013, 22 pages.
Decision Motion to Withdraw § 42.10(e) filed in IPR2013-00067 on Oct. 30, 2013, 3 pages.
Petitioner's Opposition to Patent Owner Motion to Amend filed in IPR2013-00067 on Nov. 12, 2013, 20 pages.
Exhibit 1015, Cross Examination Deposition of Raymond Tonkel filed in IPR2013-00067 on Nov. 12, 2013, 114 pages.
Exhibit 1016, Declaration of Sabut Adanur Ph.D. filed in IPR2013-00067 on Nov. 12, 2013, 57 pages.
Exhibit 1017, Excerpt of Knitted Fabrics filed in IPR2013-00067 on Nov. 12, 2013, 73 pages.
Exhibit 1018, Excerpt of Bharat J. Gaijar, Wrap Knit Fabrics filed in IPR2013-00067 on Nov. 12, 2013, 16 pages.
Exhibit 1019, J. Watel, the Milanese Machine: Little Progress Made in Development of Milanese Fabric filed in IPR2013-00067 on Nov. 12, 2013, 4 pages.
Exhibit 1023, Supplemental Declaration of Edward C. Frederick filed in IPR2013-00067 on Nov. 12, 2013, 18 pages.
Patent Owner's Reply to Petitioner's Opposition to Motion to Amend filed in IPR2013-00067 on Dec. 11, 2013, 9 pages.
Exhibit 2015, Excerpts from Celanese Corporation "Man-Made Fiber and Textile Dictionary" filed in IPR2013-00067 on Dec. 11, 2013, 5 pages.
Exhibit 2016, Excerpts from Hoechst Celanese "Dictionary of Fiber & Textile Technology" filed in IPR2013-00067 on Dec. 11, 2013, 4 pages.
Exhibit 2017, Excerpts from Celanese Corporation "Man-Made Fiber and Textile Dictionary" filed in IPR2013-00067 on Dec. 11, 2013, 10 pages.
Exhibit 2018, Excerpts from Hoechst Celanese "Dictionary of Fiber & Textile Technology" filed in IPR2013-00067 on Dec. 11, 2013, 11 pages.
Exhibit 2020, transcript of Dec. 3, 2013, second cross-examination deposition of Edward C. Frederick filed in IPR2013-00067 on Dec. 11, 2013, 59 pages, 139 pages.
Exhibit 2021, transcript of Dec. 3, 2013, cross-examination deposition of Sabit Adanur filed in IPR2013-00067 on Dec. 11, 2013, 139 pages.
Petitioner's Motion to Exclude Evidence filed in IPR2013-00067 on Jan. 7, 2014, 1 page.
Exhibit 2022, signature page for transcript of Dec. 3, 2013, Frederick deposition (Ex. 2020) filed in IPR2013-00067 on Jan. 7, 2014 1 page.
Exhibit 2023, signature page for transcript of Dec. 3, 2013, Adanur deposition (Ex. 2021) filed in IPR2013-00067 on Jan. 7, 2014, 1 page.
Order Trial Hearing filed in IPR2013-00067 on Jan. 13, 2014, 4 pages.
Patent Owner Opposition to Motion to Exclude filed in IPR2013-00067 on Jan. 21, 2014, 8 pages.
Order Conduct of the Proceeding § 4.25 filed in IPR2013-00067 on Jan. 23, 2014, 3 pages.
Petitioner's Reply to Patent Owner's Opposition to Petitioner's Motion to Exclude Evidence filed in IPR2013-00067 on Jan. 28, 2014, 8 pages.
Submission of Patent Owner's Trial Hearing Demonstratives filed in IPR2013-00067 on Feb. 6, 2014, 3 pages.
Patent Owner's Trial Hearing Demonstratives filed in IPR2013-00067 on Feb. 6, 2014, 47 pages.
Oral Hearing Transcript filed in IPR2013-00067 on Mar. 5, 2014, 41 pages.
Final Written Decision filed in IPR2013-00067 on Apr. 28, 2014, 43 pages.
Exhibit 3001 filed in IPR2013-00067 on Apr. 28, 2014, 3 pages.
Exhibit 3002 filed in IPR2013-00067 on Apr. 28, 2014, 4 pages.
Notice of Appeal filed in IPR2013-00067 on Jun. 30, 2014, 5 pages.
PCT/US2009/056795, International Search Report and Written Opinion dated Apr. 20, 2010, 16 pages.
PCT/US2012/028576, International Search Report and Written Opinion dated Oct. 1, 2012, 10 pages.
PCT/US2012/028534, International Search Report and Written Opinion dated Oct. 17, 2012, 14 pages.
PCT/US2012/028559, International Search Report and Written Opinion dated Oct. 19, 2012, 9 pages.
PCT/US2012/028534, International Preliminary Report on Patentability dated Sep. 17, 2013, 8 pages.

(56) References Cited

OTHER PUBLICATIONS

PCT/US2012/028576, International Preliminary Report on Patentability dated Sep. 17, 2013, 7 pages.
*Robert M. Lyden* v. *adidas America, Inc., adidas AG, adidas International Marketing B.V., The Finish Line, Inc., and Dick's Sporting Goods, Inc.*, "Original Complaint", Case No. 3:14-CV-1586 MO, United States District Court, District of Oregon, Portland Division, filed Oct. 8, 2014, 54 pages.
Freshness Magazine (Youtube Video), "The Story Behind Nike Flyknit Technology", http://web.archive.org/web/20120225004803/http://www.freshnessmag.com/2012/02/21/the-story-behind-nike-flyknit-technology-video, published on Feb. 21, 2012, 3 pages (website screenshot submitted).
Reissue U.S. Appl. No. 95/002,094, "Patent Owner's Rebuttal Brief", filed Sep. 3, 2014, 40 pages.
Reissue U.S. Appl. No. 95/002,094, " Patent Owner's Rebuttal Brief ", filed Sep. 22, 2014, 25 pages.
Underwood, Jenny, "The Design of 3D Shape Knitted Preforms", Ph.D. Thesis for School of Fashion and Textile, Design and Social Context Portfolio, RMIT University, Nov. 2009, 201 pages.
IPR2013-00067, Excerpts from Man-Made Fiber and Textile Dictionary, Exhibit 2011, Nov. 27, 2013, 12 pages.
Japanese Patent Application No. 2013-83862, Office Action mailed Dec. 15, 2015, 4 pages (No English translation available. A summary of the Office Action is provided in the Transmittal Letter submitted herewith).
ISO 8117:2003(E), "Textile Machinery—Knitting Machines—Nominal diameters of circular machines", Second Edition, Feb. 15, 2003, 6 pages.
Burall, Paul, "CoID Design Awards", Design, Jun. 1969, pp. 46-47.
IPR2016-00920, Petition for Inter Partes Review of U.S. Pat. No. 8,042,288 filed Apr. 19, 2016, 67 pages.
IPR2016-00920, Exhibit 1003, Declaration of Lenny M. Holden, Apr. 19, 2016, 166 pages.
IPR2016-00921, Petition for Inter Partes Review of U.S. Pat. No. 7,814,598 filed Apr. 19, 2016, 57 pages.
IPR2016-00922, Petition for Inter Partes Review of U.S. Pat. No. 8,266,749 filed Apr. 19, 2016, 67 pages.
IPR2016-00921 and IPR-00922, Exhibit 1003, Declaration of Lenny M. Holden, Apr. 19, 2016, 154 pages.
Chinese Patent Application No. 201510071264.0, Office Action mailed Mar. 28, 2016, 9 pages (No English translation available. A summary of the Office Action is provided in the Transmittal Letter submitted herewith).
Office Action, Japanese Patent Application No. 2013-83862, Oct. 11, 2016, 3 pages.
Petition for Inter Partes Review Under 35 U.S.C. §§ 311-319 and 37 C.F.R. § 42.100 ET SEQ. with Exhibit 1003, Declaration of Lenny M. Holden, Inter Partes Review No. 2017-00263.
Petition for Inter Partes Review Under 35 U.S.C. §§ 311-319 and 37 C.F.R. § 42.100 ET SEQ. with Exhibit 1003, Declaration of Lenny M. Holden, Inter Partes Review No. 2017-00264.
Examination Report, German Patent Application No. 102012206062.6, mailed Jan. 26, 2017, 10 pages.
http://extension.usu.edu/files/publications/factsheet/FC_Clothing&Textiles_2012-25pr.pdf.
Federal Circuit Case Nos. 18-1180 & 18-1181, Appellant's Reply in Support of Motion to Remand, Jun. 5, 2018, 16 pages.
Federal Circuit Case Nos. 18-1180 & 18-1181, Appellant's Motion for Remand to PTAB, May 24, 2018, 19 pages.
Federal Circuit Case Nos. 18-1180 & 18-1181, Appellee's Opposition to Motion to Remand to PTAB, Jun. 1, 2018, 21 pages.
Federal Circuit Case Nos. 18-1180 & 18-1181, Federal Circuit Decision to Remand to PTAB, Jul. 2, 2018, 4 pages.
Federal Circuit Case Nos. 18-1180 & 18-1181, Appellant's Reply Brief, May 1, 2018, 41 pages.
Federal Circuit Case Nos. 18-1180 & 18-1181, Appellee's Corrected Response Brief, Apr. 12, 2018, 75 pages.
Federal Circuit Case Nos. 18-1180 & 18-1181, Appellant's Opening Brief, Feb. 26, 2018, 79 pages.
IPR2016-00921 & IPR2016-00922, Exhibit 1013, Analyzing the Color, Design and Texture of Fabric, 8 pages.
IPR2016-00921 & IPR2016-00922, Exhibit 3001, Random House Webster's College Dictionary Definition of Impart and Texture, 4 pages.
IPR2016-00921 & IPR2016-00922, Exhibit 1014, Merriam-Webster Dictionary Definition of Impart, 11 pages.
IPR2016-00921 & IPR2016-00922, Exhibit 2004, Transcript of Deposition of Lenny Holden, 226 pages.
IPR2016-00921 & IPR2016-00922, Record of Oral Hearing, Jul. 26, 2017, 74 pages.
IPR2016-00921 & IPR2016-00922, Exhibit 1016, Adidas's Oral Hearing Demonstratives, 84 pages.
"Knitting Machine Wins Design Award—Textile Institute & Industry", EBSCO Host, Textile Institute & Industry, vol. 7, Issue 7, Jul. 1969, 3 pages.
Polyamide 6.6 Emana Yarn, 5 pages.
U.S. Appl. No. 13/861,896, Final Office Action, Dec. 9, 2016, 13 pages.
U.S. Appl. No. 13/861,896 , Final Office Action, Oct. 11, 2017, 16 pages.
U.S. Appl. No. 13/861,896 , Non-Final Office Action, Jun. 9, 2016, 14 pages.
U.S. Appl. No. 13/861,896 , Non-Final Office Action, May 1, 2017, 14 pages.
U.S. Appl. No. 13/861,896 , Non-Final Office Action, Mar. 16, 2018, 21 pages.
U.S. Appl. No. 13/861,896 , Restriction Requirement, Nov. 6, 2015, 9 pages.
Aibibu et al., "Textile Cell-Free Scaffolds for in Situ Tissue Engineering Applications", Journal of Materials Science: Materials in Medicine, vol. 27, No. 3, Mar. 2016, 20 pages.
Atalay et al., "Knitted Strain Sensors: Impact of Design Parameters on Sensing Properties", Sensors, vol. 14, No. 3, 2014, pp. 4712-4730, 8 pages.
Atalay et al., "Textile-Based Weft Knitted Strain Sensors: Effect of Fabric Parameters on Sensor Properties, Sensors (Basel)", vol. 13, No. 8, Aug. 21, 2013, pp. 11114-11127, 6 pages.
Barton et al., "Development and Evaluation of a Tool for the Assessment of Footwear characteristics", Journal of Foot and Ankle Research, vol. 2, 2009, 13 pages.
Federal Circuit Case No. 14-1719 , Appellant's Opening Brief to Federal Circuit, Dec. 15, 2014, 47 pages.
Federal Circuit Case No. 14-1719 , Appellant's Reply Brief, May 27, 2015, 38 pages.
Federal Circuit Case No. 14-1719 , Appellee's Response Brief to Federal Circuit, Apr. 10, 2015, 76 pages.
Federal Circuit Case No. 14-1719 , Federal Circuit Decision, Feb. 11, 2016, 41 pages.
Federal Circuit Case No. 14-1719 , Federal Circuit Mandate to PTAB, Apr. 4, 2016, 1 page.
Federal Circuit Case No. 14-1719 , United States Patent and Trademark Office's Solicitor's Brief to Federal Circuit, Apr. 9, 2015, 27 pages.
Hamlin , "The Hamlin Cleanroom Bootie", MO-LA Inc., Technical Developments, vol. 18, Mar. 1993, 2 pages.
IPR2013-00067 , Decision on Remand, Sep. 18, 2018, 65 pages.
IPR2013-00067 , Exhibit 1027, Petitioner's Oral Hearing Demonstratives Slides, 25 pages.
IPR2013-00067 , Exhibit 3003, Email regarding Aqua Products Conference Call, 3 pages.
IPR2013-00067 , Order Conduct of Remand Proceeding, Aug. 10, 2016, 4 pages.
IPR2013-00067 , Patent Owner's Notice of Appeal, Jun. 30, 2014, 5 pages.
IPR2013-00067 , Patent Owner's Response Brief, Nov. 16, 2017, 12 pages.
IPR2013-00067 , Petitioner's Opening Brief, Nov. 6, 2017, 12 pages.
IPR2013-00067 , Petitioner's Reply Brief on Remand, Nov. 22, 2017, 6 pages.
IPR2016-00920 , Decision Denying Institution of Inter Partes Review, Oct. 20, 2016, 8 pages.

(56) References Cited

OTHER PUBLICATIONS

IPR2016-00921 , Petitioner's Notice of Supplemental Evidence in Response to Patent Owner's Objection to Evidence, May 12, 2017, 4 pages.
IPR2016-00921 , Decision on Institution of Inter Partes Review, Oct. 21, 2016, 24 pages.
IPR2016-00921 , Final Written Decision, Oct. 19, 2017, 49 pages.
IPR2016-00921 , Order Modifying Institution Decision and Granting Request for Additional Briefing, Aug. 24, 2018, 14 pages.
IPR2016-00921 , Patent Owner's Objection to Admissability of Evidence, Apr. 28, 2017, 4 pages.
IPR2016-00921 , Patent Owner's Response Brief, Jan. 23, 2017, 64 pages.
IPR2016-00921 , Patent Owner's Response Brief Addressing the Newly Instituted Ground, Sep. 24, 2018, 14 pages.
IPR2016-00921 , Petitioner's Brief Addressing Newly Instituted Ground, Sep. 10, 2018, 12 pages.
IPR2016-00921 , Petitioner's Notice of Appeal, Nov. 13, 2017, 4 pages.
IPR2016-00921 , Petitioner's Reply to Patent Owner Response, Apr. 21, 2017, 32 pages.
IPR2016-00922 , Petitioner's Notice of Supplemental Evidence in Response to Patent Owner's Objections to Evidence 37 C.F.R. § 42.64(B)(1), May 12, 2017, 4 pages.
IPR2016-00922 , Final Written Decision, Oct. 19, 2017, 52 pages.
IPR2016-00922 , Order Modifying Institution Decision and Granting for Additional Briefing, Aug. 24, 2018, 14 pages.
IPR2016-00922 , Patent Owner's Objection to Admissability of Evidence, Apr. 28, 2017, 4 pages.
IPR2016-00922 , Patent Owner's Response Brief, Jan. 23, 2017, 66 pages.
IPR2016-00922 , Patent Owner's Response Brief Addressing Newly Instituted Ground, Sep. 24, 2018, 14 pages.
IPR2016-00922 , Petitioner's Brief Addressing Newly Instituted Ground, Sep. 10, 2018, 12 pages.
IPR2016-00922 , Petitioner's Notice of Appeal, Nov. 13, 2017, 4 pages.
IPR2016-00922 , Petitioner's Reply Brief, Apr. 21, 2017, 34 pages.
IPR2017-00263 , Decision Denying Institution of Inter Partes Review, Jun. 7, 2017, 11 pages.
IPR2017-00263 , Decision Denying Request for Rehearing, Jul. 20, 2017, 12 pages.
IPR2017-00263 , Patent Owner's Corrected Preliminary Response, Mar. 27, 2017, 24 pages.
IPR2017-00263 , Patent Owner's Preliminary Response, Mar. 9, 2017, 24 pages.
IPR2017-00263 , Petitioner's Request for Rehearing, Jul. 7, 2017, 17 pages.
IPR2017-00264 , Decision Denying Institution of Inter Partes Review, Jun. 7, 2017, 12 pages.
IPR2017-00264 , Decision Denying Request for Rehearing, Jul. 20, 2017, 12 pages.
IPR2017-00264 , Patent Owner's Corrected Preliminary Response, Mar. 27, 2017, 24 pages.
IPR2017-00264 , Patent Owner's Preliminary Response, Mar. 9, 2017, 24 pages.
IPR2017-00264 , Petitioner's Request for Rehearing, Jul. 7, 2017, 17 pages.
Lo et al., "Effects of Custom-Made Textile Insoles on Plantar Pressure Distribution and Lower Limb Emg Activity During Turning", Journal of Foot and Ankle Research, vol. 9, Jul. 13, 2016, 11 pages.
Office Action, Chinese Patent Application No. 201710111530.7, Aug. 24, 2018.
Office Action, Japanese Patent Application No. 2017-093544, Jul. 10, 2018, 7 pages.
Saenz-Cogollo et al., "Pressure Mapping Mat for Tele-Home Care Applications", Sensors, vol. 16, No. 3, Mar. 11, 2016, E365, 9 pages.
Singh et al., "Medical Textiles as Vascular Implants and Their Success to Mimic Natural Arteries", Journal of functional biomaterials, vol. 6, No. 3, Sep. 2015, pp. 500-525, 15 pages.
Stoppa et al., "Wearable Electronics and Smart Textiles: A Critical Review, Sensors", vol. 14, No. 7, 2014, p. 11957-11992, 20 pages.
Lu, Z., et al., "The Development of the Flat-Knitted Shaped Uppers Based on Ergonomics," AUTEX Research Journal, vol. 16, No. 2, pp. 66-74 (Jun. 2016).
Hong, H., et al., "The development of 3D shaped knitted fabrics for technical purposes on a flat knitting machine," Indian Journal of Fibre & Textile Research, vol. 19, pp. 189-194 (Sep. 1994).
Buckley, R., New Textile Concepts for Use in Control of Body Environments (2001).
Adidas adiZero Prime SP Olympia (2012).
Yarns map adiZero adios (2012).
European Search Report, European Patent Application No. 20165825.9, Aug. 13, 2020, 9 pages.
IPR2013-00067, Petitioner's Opening Brief on Remand, Aug. 20, 2020, 12 pages.
IPR2013-00067, Exhibit 2024, Intervenor's Petition for Panel Hearing, Appeal No. 2015-1928, Feb. 5, 2018, 38 pages.
IPR2013-00067, Petitioner's Response Brief on Remand, Sep. 3, 2020, 7 pages.
IPR2013-00067, Patent Owner's Reply Brief on Second Remand, Sep. 3, 2020, 7 pages.
IPR2013-00067, Patent Owner's Opening Brief on Second Remand, Aug. 20, 2020, 12 pages.
Aramids. Macro-Galleria. Polymer Science Learning Center. URL= https://www.pslc.ws/macrog/aramid.htm. Accessed May 15, 2020. Publication date: Feb. 1, 2001.
Chinese Patent Application No. 201410160626.9, Office Action mailed May 10, 2016, with attached English-language translation, 17 pages.
Chinese Patent Application No. 201510071264.0, Office Action mailed Mar. 28, 2016, with attached English-language translation, 17 pages.
Eberle et al., "Clothing Technology . . . from fibre to fashion", Europa Lehrmittel, Third Edition, 2002, 293 pages.
Excerpts from Man-Made Fiber and Textile Dictionary, filed as Exhibit 2011 in IPR2013-00067 on Aug. 19, 2013, 12 pages.
Exhibit 2023, Copy of signature page for transcript of Dec. 3, 2013, Adanur deposition (Ex. 2021) filed in IPR2013-00067 on Jan. 7, 2014, 1 page.
Federal Circuit Case No. 19-1262, Appellee Adidas AG's Response Brief, Aug. 9, 2019, 60 pages.
Federal Circuit Case No. 19-1787, Appellant Adidas AG's Opening Brief, Aug. 30, 2019, 319 pages.
IPR2016-00922, Decision on Institution of Inter Partes Review, Oct. 21, 2016, 24 pages.
Notice of Opposition, European Patent Application No. 13161357.2, Mar. 26, 2019, 48 pages.
Office Action, European Patent Application No. 14165042.4, Jun. 26, 2018, 6 pages.
Office Action, German Patent Application No. 102013207156.6, Sep. 19, 2017, 4 pages (see transmittal for summary).
Office Action, German Patent Application No. 102013207156.6, Mar. 24, 2014, 5 pages (see transmittal for summary).
Office Action, Japanese Patent Application No. 2014-077414, Aug. 13, 2019, with attached English-language translation, 8 pages.
Office Action, Japanese Patent Application No. 2014-077414, Feb. 27, 2018, with attached English-language translation, 8 pages.
Patent Owner's Opposition to Motion to Exclude filed in IPR2013-00067 on Jan. 21, 2014, 8 pages.
Petition for Inter Partes Review Under 35 U.S.C. §§ 311-319 and 37 C.F.R. § 42.100 et seq., filed Nov. 28, 2012 in IPR2013-00067, 65 pages.
Petitioner's Motion to Exclude Evidence filed in IPR2013-00067 on Jan. 7, 2014, 8 pages.
Petitioner's Opposition to Patent Owner's Motion to Amend filed Nov. 12, 2013 in IPR2013-00067, 20 pages.
U.S. Appl. No. 15/440,883, First Action Interview—Pilot Program Pre-Interview-Communication, mailed Mar. 23, 2017, 5 pages.

(56) References Cited

OTHER PUBLICATIONS

U.S. Appl. No. 15/440,883, Non-Final Office Action, mailed Sep. 29, 2017, 8 pages.
U.S. Appl. No. 15/440,883, Final Office Action, mailed Apr. 6, 2018, 9 pages.
Federal Circuit Case No. 19-1787, Reply Brief for Appellant Adidas AG, Dec. 23, 2019, 40 pages.
Federal Circuit Case No. 19-1787, Joint Appendix, Dec. 30, 2019, 582 pages.
Federal Circuit Case No. 19-1787, Appellee Nike, Inc.'s Response Brief, Nov. 25, 2019, 77 pages.
Federal Circuit Case No. 19-1262, Appellant's Citation of Supplemental Authority Pursuant to Rule 28(j), Jan. 29, 2020, 11 pages.
Appellee Nike Response to Citation of Supplemental Authority, Federal Circuit Case No. 19-1987, May 20, 2020, 3 pages.
Appellant Adidas Citation of Supplemental Authority, Federal Circuit Case No. 19-1787, May 15, 2020, 31 pages.
Opinion, Federal Circuit Case Nos. 19-1787 and 19-1788, Jun. 25, 2020, 8 pages.
Decision on Appeal, Federal Circuit Case No. 19-1262, Apr. 9, 2020, 17 pages.
Judgment, Federal Circuit Case No. 19-1262, Apr. 9, 2020, 1 page.
Chamberlain, "Knitted Fabrics", 1919, pp. 80-103, Sir Isaac Pitman & Sons, Ltd., London.
Chamberlain, "Principles of Machine Knitting", 1951, pp. 54-57, The Textile Institute, Manchester.
Wignall , "Knitting", 1964, pp. 99-101, 116-129, Pitman Publishing, London.
European Extended Search Report, European Patent Application No. 14165042.4, Jul. 16, 2014, 7 pages.
Office Action, Japanese Patent Application No. 2014-077414, Dec. 25, 2018, with attached English-language translation; 10 pages.
Office Action, Chinese Patent Application No. 201410160626.9, Jul. 23, 2015, with attached English-language translation; 19 pages.
Office Action, Chinese Patent Application No. 201410160626.9, Dec. 27, 2016, with attached English-language translation; 21 pages.
Summons to Attend Oral Hearing, European Patent Application No. 14165042.4, Mar. 1, 2019, 6 pages.
U.S. Appl. No. 16/372,055, Final Office Action, mailed Feb. 27, 2020, 19 pages.
Advisory Action, U.S. Appl. No. 16/372,055, filed May 27, 2020, 5 pages.
Advisory Action, U.S. Appl. No. 16/197,189, filed May 20, 2020, 8 pages.
Non-Final Office Action, U.S. Appl. No. 16/197,181, filed May 27, 2020, 21 pages.
Notice of Allowance, U.S. Appl. No. 15/440,883, filed May 13, 2020, 8 pages.
Federal Circuit Case No. 19-1262, Reply Brief of Appellant Nike, Inc., Sep. 13, 2019, 38 pages.
IPR2016-00922, Petitioner adidas AG's Notice of Appeal, Apr. 19, 2019, 75 pages.
IPR2016-00922, Decision on Remand—35 USC 144 and 37 CFR 42.5(a), Feb. 19, 2019, 71 pages.
IPR2016-00921, -00922, Transcript of Hearing Held Oct. 15, 2018, Oct. 17, 2018, 44 pages.
IPR2016-00921, -00922, Petitioner's Demonstratives for Supplemental Oral Hearing, Nov. 7, 2018, 21 pages.
IPR2016-00921, -00922, Patent Owner Nike's Demonstratives Jul. 11, 2017, 27 pages.
IPR2016-00921, -00922, Nike's Demonstratives for Additional Oral Hearing Nov. 7, 2018, 21 pages.
IPR2016-00921, -00922, Hearing Transcript, Nov. 15, 2018, 37 pages.
IPR2016-00921, Petitioner adidas AG's Notice of Appeal Apr. 19, 2019, 71 pages.
IPR2016-00921, Decision on Remand—35 USC 144 and 37 CFR42.5(a), Feb. 19, 2019, 67 pages.
IPR2013-00067, Nike's Notice of Appeal, Nov. 20, 2018, 69 pages.
Federal Circuit Case No. 19-1262, Principal Brief of Appellant Nike, Inc., May 17, 2019, 125 pages.
U.S. Appl. No. 15/440,883, Non-Final Office Action, May 2, 2019, 12 pages.
U.S. Appl. No. 14/257,668, Final Office Action, Feb. 1, 2019, 29 pages.
U.S. Appl. No. 14/257,719, Final Office Action, Jan. 24, 2019, 15 pages.
U.S. Appl. No. 14/619,586, Non-Final Office Action, Jan. 14, 2019, 10 pages.
Order—Conduct of the Proceeding on Remand, IPR Case No. 2013-00067, Jul. 24, 2020, 6 pages.
U.S. Appl. No. 16/372,055, Non Final Office Action, Jul. 22, 2020, 23 pages.

* cited by examiner

SHOE UPPER

CROSS REFERENCE TO RELATED APPLICATIONS

This application is a continuation of U.S. patent application Ser. No. 13/861,896, field on Apr. 12, 2013, entitled SHOE UPPER ("the '896 application"), which is related to and claims priority benefits from German Patent Application No. DE 10 2012 206062.6, filed on Apr. 13, 2012, entitled SHOE UPPER ("the '062 application"), and European Patent Application No. 13161357.2, filed on Mar. 27, 2013, entitled SHOE UPPER ("the '357 application"). The '896, '062 and '357 applications are hereby incorporated herein in their entireties by this reference.

FIELD OF THE INVENTION

The present invention relates to a shoe upper for a shoe, in particular a sports shoe, comprising a knitted fabric, and to a method of manufacture of such a shoe upper.

BACKGROUND

Conventional shoes essentially comprise two elements: a sole and a shoe upper. Whereas a sole often consists of only one material (e.g. rubber or leather) or of only a few materials, various materials are often used in a shoe upper for different parts of the foot, in order to provide different functions. As a result, there are various individual parts. A typical shoe upper for a sports shoe may comprise more than fifteen parts. During manufacture, the assembly of these parts is particularly time-consuming and often carried out by manual labor. Moreover, such a manufacturing technique produces a large amount of waste.

In order to reduce production efforts, it is therefore known to knit a shoe upper in one piece. Knitting shoe uppers has the advantage that they can be manufactured in one piece but may still comprise various structures with a variety of characteristics. Moreover, the one piece shoe upper is already manufactured in its final shape and usually only requires to be closed in one section. This approach does not produce any waste by the final shape being cut out. Knitted shoe uppers are described in U.S. Pat. Nos. 2,147,197, 1,888,172, 5,345,638, and PCT Pub. No. WO1990/003744, for example.

U.S. Pat. No. 7,774,956 describes a shoe upper with zones of multiple properties (e.g. stretchability) by using different yarns and/or stitch patterns. Additionally, pockets, tunnels, or layered structures are manufactured by knitting. U.S. Publication No. 2011/0078921, now U.S. Pat. No. 9,149, 086, describes a shoe upper in which various elements, such as e.g. the tongue or the upper edge of the heel, are manufactured by knitting.

In contrast to woven textile materials or other less elastic materials, a knitted shoe upper has considerably greater stretchability, owing to the textile structure created by intertwined stitches. It may therefore be desirable to reduce the stretchability of the knitted material for use as a shoe upper. U.S. Pat. No. 2,314,098 describes a shoe upper, certain portions of which are stiffened by the use of yarns for the textile material that contain synthetic filaments, which are heat treated so that the textile material melts and subsequently solidifies. U.S. Pub. No. 2010/0154256, now U.S. Pat. No. 8,490,299, describes a thermoplastic yarn that is melted in different regions. The use of thermoplastic yarns for knitting shoe uppers and subsequent thermal treatment for altering the properties of the material or for shaping are described in U.S. Pat. Nos. 2,314,098, 2,641,004, 2,440,393, and U.S. Pub. No. 2010/0154256, now U.S. Pat. No. 8,490, 299.

Reduced stretching of a knitted shoe upper by applied structures is described in U.S. Pat. Nos. 7,637,032, 7,347, 011, and 6,931,762. In U.S. Pat. No. 4,785,558, a shoe upper consists of an outer knit fabric layer and an inner knit fabric layer connected by a synthetic monofilament in order to achieve suitable elasticity and air permeability.

U.S. Pat. Nos. 7,047,668 and 4,447,967 describe shoe uppers with a polymeric outer layer manufactured in a mold and an inner layer formed of a textile material. In German Pat. No. DE102009028627, a shoe upper is reinforced by reinforcement ribs on the inside.

However, the previous solutions for limiting the stretchability of knitted shoe uppers have disadvantages. The use of thermoplastic materials alters the appearance of the knitted textile material and limits design options. The use of additionally applied structures also alters the appearance of the knitted textile material, since they are applied to the outside of the shoe upper. Moreover, the number of parts of the shoe upper and thus the manufacturing effort is increased. Applying them on the inside might cause pressure sores at the foot leading to a limitation of the design of the outside of the shoe upper. The shape of the applied structures also reduces stretchability only in certain directions.

In view of the prior art, it is therefore an object of the present invention to provide a shoe upper with knitted fabric, which overcomes the described disadvantages and which effectively limits the stretchability of the knitted fabric without the outer appearance of the knitted fabric being adversely affected.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to a first aspect, this problem is solved by a shoe upper for a shoe, in particular a sports shoe in accordance with claim 1. The shoe upper comprises a first portion and a second portion, which are jointly manufactured as a knitted fabric, wherein only one of the portions is reinforced by a coating of a polymer material applied to the shoe upper.

Due to the applied polymer coating, the stretchability of the knitted fabric is specifically reduced in a portion without affecting the outer appearance of the knitted fabric and without limiting the design options of the knitted fabric. Thus, the structure of the knitted fabric does not have to be altered in order to achieve its advantages such as increased air permeability. At the same time, the stretchability of the knitted fabric is effectively reduced in any desired directions of movement. The polymer coating furthermore increases the stiffness and stability of the knitted fabric.

In further embodiments, the knitted fabric is weft-knitted or warp-knitted. Flat knitted fabric has the advantage that the outline of the shoe upper is manufactured directly, without having to subsequently cut out the knitted fabric and to process it further at the edges.

According to some embodiments, the coating of a polymer material is applied to the inside of the shoe upper. Thus, the outer appearance of the knitted fabric remains unaffected by the polymer layer.

The polymer material may be applied to the shoe upper in a liquid state. In some embodiments, the polymer material has a viscosity in the range of about 15-80 Pa·s at about 90-150° C., and may further have a viscosity in the range of about 15-50 Pa·s at about 110-150° C. Further, the applied polymer material may have a hardness in the range of about 40-60 shore D. These values provide the necessary reduction of stretchability of the knitted fabric but maintain the required elasticity of the knitted fabric.

The polymer material may be applied in layers with a thickness of about 0.2-1 mm. The polymer material may also be applied in several layers, e.g. on top of each other or in an overlapping fashion. Thus, the polymer material can be sprayed on and adjusted to the respective requirements on the overall thickness of the polymer material. In this regard, several layers, e.g. at least two layers, may have different thicknesses. There may be continuous transitions between areas of different thicknesses, in which the thickness of the polymer material continuously increases or decreases, respectively. In the same manner, two different polymer materials may be used in different areas in order to achieve desired properties.

The portion that is reinforced with the polymer material may be arranged in the toe area, the heel area, in the area of the tongue, on a lateral side in the midfoot area and/or on a medial side in the midfoot area of the shoe upper. Reducing stretching of the knitted fabric by a polymer material is particularly desirable in these areas. Further reinforced areas may be the area of the eyelets, the area of the sole or the ankles (if the shoes are sufficiently high).

According to certain embodiments, the first and/or the second portion of the knitted fabric comprises a first textile layer and a second textile layer, wherein the first textile layer comprises a yarn, and wherein the second textile layer comprises a monofilament. It is preferable for the portion coated with the polymer material to comprise the first textile layer and the second textile layer. It is also preferable for the second textile layer to be coated with the polymer material, i.e. the polymer material is arranged on the second textile layer. In other embodiments, it may be preferable that the portion comprising the first textile layer and the second textile layer is arranged in the area of the toes, the midfoot, the heel and/or the eyelets of the shoe upper.

In certain embodiments, the knitted textile furthermore comprises a fuse yarn comprising a thermoplastic material. The fuse yarn may be arranged (e.g. knitted into) in the first textile layer and/or the second textile layer. Furthermore, the fuse yarn may be arranged between the first textile layer and the second textile layer (e.g. placed between the layers). Upon applying pressure and temperature, the fuse yarn fuses with the knitted material and reinforces the knitted fabric. In doing so, the arrangement of the fuse yarn between the first textile layer and the second textile layer has the advantage that the mould does not get dirty during pressing. In certain embodiments, the material should not be in direct contact with the mould.

In certain embodiments, the first textile layer and the second textile layer are connected by weft-knitting or by warp-knitting. Thus, the monofilament, which is less elastic, can effectively reduce stretching of the more elastic yarn. This reduces stretching of the knitted fabric, wherein every single stitch is limited in stretching.

A further aspect of the invention is a shoe upper for a shoe, in particular a sports shoe with a least one portion comprising a weft-knitted fabric. The weft-knitted fabric comprises a first weft-knitted layer of a yarn and a second weft-knitted layer of a monofilament. The second weft-knitted layer and the first weft-knitted layer are connected such that the stretching of the first weft-knitted layer is reduced by the second weft-knitted layer.

The second weft-knitted layer may be only connected to the first weft-knitted layer. The second textile layer may be knitted into the first textile layer, i.e. the first and second textile layers may be interknitted. As a result, stretching of the first weft-knitted layer can be effectively reduced by the second weft-knitted layer, since the monofilaments of the second weft-knitted layer are not elastically deformable. While the second textile layer of a monofilament is indeed stretchable due to its stitches, it is considerably less than the first textile layer of yarn.

Preferably, the first textile layer comprises apertures for ventilation. Further, the second textile layer may comprise larger stitches than the first textile layer.

Further aspects of the invention include a method of manufacture of a shoe upper for a shoe, in particular a sports shoe, wherein the shoe upper comprises a first portion and a second portion that are jointly manufactured as knitted fabric. The method comprises a step of applying a polymer layer as a coating in only one of the two portions of the shoe upper.

The method may further comprise a step of pressing the polymer coated portion of the shoe upper under pressure and heat. The polymer melts due to pressure and heat and fuses with the yarn. Thus, the stiffness of the knitted fabric is increased and its stretching is decreased in the coated portion.

The polymer coating may be sprayed on, applied with a scraper or coating knife or by laying on. By means of such method steps the polymer material can be applied to the portion to be coated with particular ease.

In other embodiments, the knitted fabric comprises a first textile layer and a second textile layer, wherein the first textile layer comprises a yarn, and wherein the second textile layer comprises a monofilament. In this regard, the method further comprises the steps of applying the polymer material to the second textile layer and subjecting the shoe upper to pressure and heat, wherein the polymer material melts and penetrates the second textile layer, thus essentially coating the first textile layer. In the second step, the polymer material essentially connects to the fibers of the first textile layer, thus reinforcing the first textile layer. During this process, stitches are positioned relative to each other, either at their points of intersection or by the entire stitch being surrounded by the polymer and thus positioned or otherwise secured.

In further embodiments, an additional step of the method is compression-molding the coated textile material. By compression-molding the coated textile material the shoe upper can be provided with a certain shape in certain areas, e.g. a curved shape in the area of the heel or the toes. The shape of the shoe upper can either be adjusted to the last or to the foot itself.

In this regard, the yarn of the first textile layer and the monofilament of the second textile layer may comprise a higher melting point than the polymer material. Thus, it is possible that only the polymer material melts at suitable temperatures and fuses with the yarn of the first textile layer, without the yarn and the monofilament being destroyed or damaged.

In some embodiments, the yarn of the first textile layer comprises a fuse yarn, which comprises a thermoplastic material. Thus, the fuse yarn can fuse with the yarn and reinforce it when subjected to heat and pressure. Therein, it may be desirable for the monofilament and the yarn to comprise a higher melting point than the fuse yarn so that only the fuse yarn melts at suitably selected temperatures during pressing. In this regard, it may also be desirable that the monofilament and the yarn comprise a higher melting point than the thermoplastic material of the fuse yarn.

Further embodiments are described in further dependent patent claims.

BRIEF DESCRIPTION OF THE DRAWINGS

In the following detailed description, embodiments of the invention are described referring to the following figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, embodiments and variations of the present invention are described in more detail referring to a shoe upper for a shoe, in particular a sports shoe. However, the present invention can also be used otherwise, e.g. for clothing or accessories where supporting functions, stiffening, increased abrasion resistance, elimination of stretchability, increased comfort and precise fit to prescribed geometries are required.

The use of the weft-knitting technique enables a shoe upper to comprise areas with different characteristics, while it still can be manufactured in one single operation. The various characteristics or functions of the areas include stiffness, stability and comfort, for example. Various techniques are used in order to achieve such characteristics or functions, which will be described in the following. The described techniques include suitable knitting techniques (e.g. Jacquard, inlaid works and/or gusset technique), the selection of fibers and yarns, the coating of the textile material with a polymer, the use of monofilaments, the combination of monofilaments and polymer coating, the application of fuse yarns and multi-layer textile material. These and other techniques will be explained in the following, before embodiments of shoe uppers will be described that apply these techniques.

5.1 Textile Material

Figure 1:
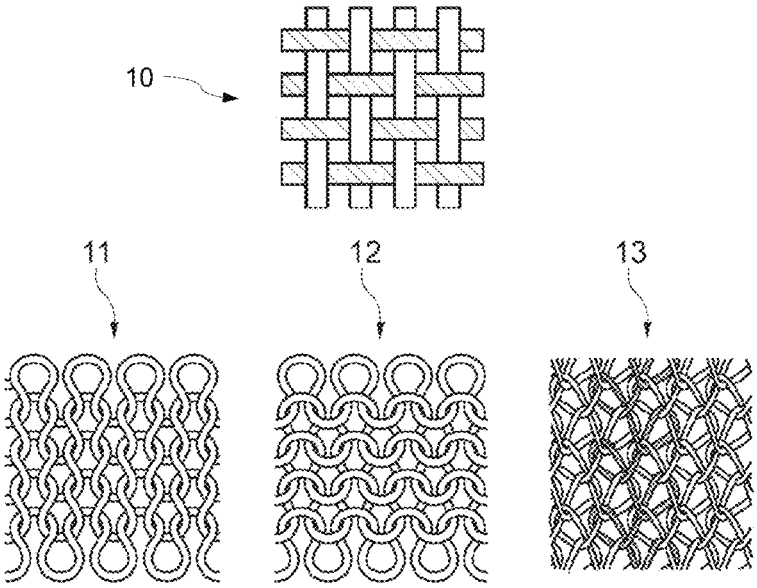
FIG. 1 is a schematic representation of textile structures.

As shown in FIG. 1, a woven textile material 10 is of lesser complexity than a weft-knitted textile material 11, 12 or warp-knitted textile material 13. Weft-knitted and warp-knitted textile materials are also referred to as knitted fabrics. The essential characteristic of knitted fabric is that it is manufactured from yarns that are looped to form so-called stitches.

Knitted fabrics constitute the majority of textile materials used for shoes. An essential advantage of knitted fabric over woven textiles is the variety of structures and surfaces that can be created with it. Using essentially the same manufacturing technique, it is possible to manufacture both very heavy and stiff materials and very soft, transparent and stretchable materials. The properties of the material can be influenced by the weft-knitting pattern, the yarn, and the needle size.

Weft-knitted textile materials are currently used for the manufacture of shoe uppers only to a limited extent, particularly for shoe lining. Textile materials of shoe uppers and the majority of shoe lining materials are mainly warp-knitted textile materials.

Figure 2:
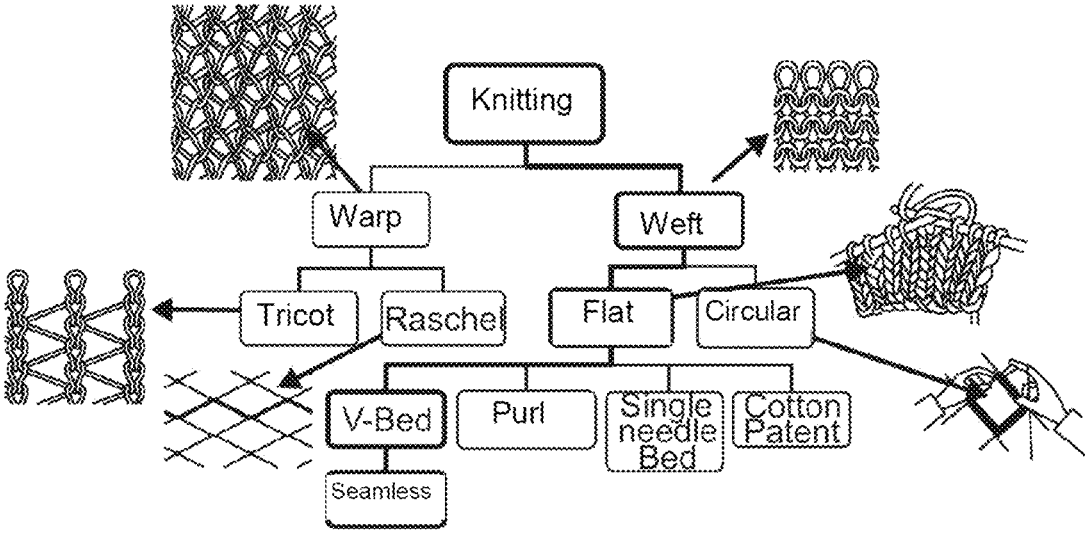
FIG. 2 is an overview of types of knitted fabrics.

Weft-knitted textile materials 11, 12 are created by knitting with one thread from the left to the right. View 11 shows a front view and view 12 shows a back view of a weft-knitted material. In contrast, warp-knitted textile materials 13 are created by warp-knitting with many threads from the top to the bottom. The further classification of warp-knit goods and weft-knit goods is illustrated in FIG. 2. The advantages of weft-knitting over warp-knitting are essentially the greater variability of stitch structures in terms of combinations and weft-knitting patterns that can be used in weft-knitting machines. In particular, it is possible to create individual zones of different structures with weft-knitting. By contrast, in case of warp-knitting, the entire product has to comprise the same structure. In addition, there is the possibility of functional weft-knitting (i.e. functional knitted fabrics can be created by selecting the type of weft-knitting or the yarn) and the possibility of giving the weft-knitted textile material a certain shape, i.e. an outline. This is impossible with warp-knitting.

The manufacture of the final shape or outline is possible by flat knitting. To this end, a three-dimensional shape of the shoe upper has to be created by closing a seam. Creating a final outline is not possible in circular knitting. Here, it is necessary to cut out the final shape from the knitted material and to provide it with a seam along the edge.

Thus, the weft-knitting technique allows manufacturing of textile materials with different functional areas and simultaneously maintaining their outlines. As a result, it is possible to manufacture shoe uppers in one operation by means of the weft-knitting technique, as illustrated in FIGS. 5 and 7-9.

The structures of a weft-knitted material can be adjusted to functional requirements in certain areas, by weft-knitting patterns, the yarn or the needle size being selected accordingly. It is possible, for example, to include structures with large stitches or apertures within the weft-knitted textile material in areas where ventilation is desired. By contrast, in areas where support and stability are desired, fine-meshed weft-knitting patterns, stiffer yarns or even multi-layered weft-knitting structures can be used, which will be described in the following. The thickness of the weft-knitted textile material is equally variable.

5.2 Fibers

Fibers are usually of a rather short length and are spun or twisted into threads or yarns. However, fibers can also be long and twirled into a yarn. Fibers may consist of natural or synthetic materials. Natural fibers include cotton, wool, alpaca, hemp, coconut fibers or silk. Among the synthetic fibers are polymer-based fibers such as nylon, polyester, Spandex or Kevlar, which can be produced as classic fibers or as high-performance or technical fibers.

Figure 3:
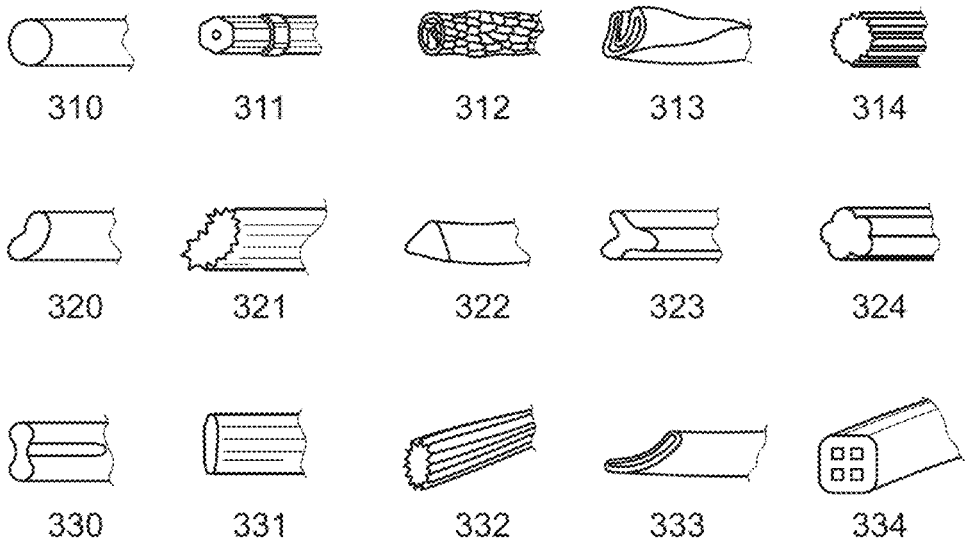
FIG. 3 are cross-sectional views of fibers for yarns that are used in a shoe upper according to certain embodiments of the present invention.

The mechanical and physical properties of a fiber and the yarn manufactured therefrom are also determined by the fiber's cross-section, as illustrated in FIG. 3. The different cross-sections, their properties, and examples of materials having such cross-sections will be explained in the following.

A fiber having the circular cross-section 310 can either be solid or hollow. A solid fiber is the most frequent type; it allows easy bending and is soft to the touch. A fiber as a hollow circle with the same weight/length ratio as the solid fiber has a larger cross-section and is more resistant to bending, since deformations occur during bending. Examples of fibers with a circular cross-section are nylon, polyester, and Lyocell.

A fiber having the bone-shaped cross-section 330 has the property of wicking moisture. Examples of such fibers are acrylic or spandex. The concave areas in the middle of the fiber support moisture being passed on in the longitudinal direction, whereby moisture is rapidly wicked from a certain place and distributed.

The following further cross-sections are illustrated in FIG. 3:

- Polygonal cross-section 311, hollow; example: flax;
- Oval to round cross-section 312 with overlapping sections; example: wool;
- Flat, oval cross-section with expansion and convolution 313; example: cotton;
- Circular, serrated cross-section with partial striations 314; example: rayon;
- Lima bean cross-section 320; smooth surface;
- Serrated lima bean cross-section 321, example: Avril rayon;
- Triangular cross-section with rounded edges 322; example: silk;
- Trilobal star cross-section 323; like triangular fiber with shinier appearance;
- Clubbed cross-section 324 with partial striations; sparkling appearance; example: acetate;
- Flat and broad cross-section 331; example: acetate;
- Star-shaped or concertina cross section 332;
- Cross-section in the shape of a collapsed tube with a hollow center 333; and
- Square cross-section with voids 334; example: Anso IV® nylon.

Individual fibers with their properties that are relevant for the manufacture of shoe uppers will be described in the following:

- Aramid fibers: good resistance to abrasion and organic solvents; non-conductive; temperature-resistant up to 500° C.; low flammability; sensitive to acids, salts and UV radiation.
- Para-aramid fibers: known under trade names Kevlar®, Technora®, and Twaron®; outstanding strength-to-weight properties; high Young's modulus and high tensile strength (higher than with meta-aramides); low stretching and low elongation at break (approx. 3.5%); difficult to dye.
- Meta-aramides: known under trade names Nomex®, Teijinconex®, NewStar®, X-Fiper™.
- Dyneema® fibers: highest impact strength of any known thermoplastics; highly resistant to corrosive chemicals, with exception of oxidizing acids; extremely low moisture absorption; very low coefficient of friction, which is significantly lower than that of nylon and acetate and comparable to Teflon®; self-lubricating; highly resistant to abrasion (15 times more resistant to abrasion than carbon steel); better abrasion resistance than Teflon®; odorless; tasteless; nontoxic.
- Carbon fiber: an extremely thin fiber about 0.005-0.010 mm in diameter, composed essentially of carbon atoms; highly stable with regard to size; one yarn is formed from several thousand carbon fibers; high tensile strength; low weight; low thermal expansion; relatively expensive when compared to similar materials such as fiberglass or plastic; very strong when stretched or bent; weak when compressed or exposed to high shock so that it will crack easily if hit with a hammer; thermal conductivity; and electric conductivity, so that it is difficult to manufacture textile materials in rooms with electronic devices.
- Glass fiber: high surface to weight ratio, whereas the increased surface makes the glass fiber susceptible to chemical attack; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; moisture accumulates easily, which can worsen microscopic cracks and surface defects and lessen tensile strength; correlation between bending diameter of the fiber and the fiber diameter; thermal, electrical and sound insulation; higher stretching before it breaks than carbon fibers.

5.3 Yarns

The following yarns can be applied for textile materials for shoe uppers:

Functional yarns are capable of transporting moisture and thus of absorbing sweat and moisture. They can be electrically conducting, self-cleaning, thermally regulating and insulating, flame resistant, and UV-absorbing, and may enable infrared remission. They may be suitable for sensors.

Stainless steel yarn contains fibers made of a blend of nylon or polyester and steel. Its properties include high abrasion resistance, higher cut resistance, high thermal abrasion, high thermal and electrical conductivity, higher tensile strength and high weight. Stainless steel yarn is only available in grey steel colors to date.

Electrically conducting yarns for the integration of electronic devices in textile materials.

Fuse yarns (see also section 5.7) are a mixture of a thermoplastic yarn and polyester or nylon. There are essentially three types of fuse yarn: a thermoplastic yarn surrounded by a non-thermoplastic yarn; a non-thermoplastic yarn surrounded by thermoplastic yarn; and pure fuse yarn of a thermoplastic material. After being heated to the melting temperature, the thermoplastic yarn fuses with the non-thermoplastic yarn (e.g. polyester or nylon), stiffening the textile material. The melting temperature of the thermoplastic yarn is defined accordingly.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

Further yarns for application in shoe uppers are luminescent or reflecting yarns.

5.4 Polymer Coating

Due to their structure with loops/stitches, weft-knitted or warp-knitted textile materials are considerably more flexible and stretchable than woven textile materials. For certain applications and requirements, e.g. in certain areas of a shoe upper, it is therefore necessary to reduce flexibility and stretchability in order to achieve sufficient stability.

For this purpose, a polymer coating may be applied to one side or both sides of knitted fabrics (weft-knit or warp-knit goods), but generally also to other textile materials. Such a polymer coating causes a reinforcement and/or stiffening of the textile material. In a shoe upper, it can serve the purpose of supporting and/or stiffening in the area of the toes, in the area of the heel, or in other areas, for example. Furthermore, the elasticity of the textile material and particularly the stretchability are reduced. Moreover, the polymer coating protects the textile material against abrasion. Furthermore, it is possible to give the textile material a three-dimensional shape by means of the polymer coating using compression-molding.

In a first step of polymer coating, the polymer material is applied to one side of the textile material. However, it can also be applied to both sides. The material can be applied by spraying on, coating with a scraper or coating knife, laying on, printing on, sintering, spreading, or by applying a polymer bead. An important method of applying is spraying on, which may be automatically performed. This can be carried out by a tool similar to a hot glue gun. Spraying on enables the polymer material to be evenly applied in thin layers. Moreover, spraying on is a fast method.

In various embodiments, the polymer spray on process may be automated. Preferably, the polymer material may be sprayed on in an automated process with a robot. The design of the polymer coating, e.g. its thickness and its two-dimensional or three-dimensional profile, may be controlled by suitably programming the robot. Thus, the spray on process may be carried out fast and reproducibly, and the design of the polymer coating can be flexibly varied as well as precisely controlled.

In further embodiments, the polymer material is applied by dipping the textile material in a polymer solution comprising polymer particles and water. The textile material may be completely dipped into the polymer solution, and the solution soaks through the textile material. Alternatively, only one surface of the textile material may be dipped or partly dipped into the solution at a time. In that case, the polymer solution may partially soak through the textile material, wherein the extent of soaking through may be controlled by the duration of the dipping process. In some embodiments, a further surface of the textile material, e.g. the opposite surface of the previously dipped-in surface, may be dipped or partly dipped into the same or into a different polymer solution having different properties such as different color pigments, different fibers, etc. Thus, the same or different polymer solution(s) may also partially soak through the textile material from further surfaces.

After the one or more dipping steps, excess polymer may be squeezed out of the textile material, e.g. with a roller, particularly in cases where the polymer solution was made to soak through the textile material. Subsequently, the textile material with soaked-in polymer is dried with heat.

In some embodiments, the polymer is applied by means of a "Foulard" technique: After dipping the textile material into a polymer solution and squeezing out excess polymer e.g. with a roller, as described above, the textile material is dried with heat such that the polymer infiltrates and/or coats the yarn of the textile material.

In other embodiments, the polymer is applied by means of a "thermosetting" technique: After the aforementioned dipping and squeezing out steps, the textile material is stretched out. Subsequently, a heat setting process is carried out.

In various embodiments, the polymer is applied in at least one layer with a thickness of about 0.2-1 mm. It can be applied in one or several layers, whereby the layers can be of different thicknesses. There can be continuous transitions from thinner areas to thicker areas between neighboring areas of different thicknesses. In the same manner, different polymer materials may be used in different areas, as will be described in the following.

During application, polymer material attaches itself to the points of contact or points of intersection, respectively, of the yarns of the textile material, on the one hand, and to the gaps between the yarns, on the other hand, forming a closed polymer surface on the textile material after the processing steps described in the following. However, in case of larger mesh openings or holes in the textile structure, this closed polymer surface may also be intermittent, e.g. so as to enable ventilation. This also depends on the thickness of the applied material: The thinner the polymer material is applied, the easier it is for the closed polymer surface to be intermittent. Moreover, the polymer material may also penetrate the yarn and soak it, thus contributing to its stiffening.

After application of the polymer material, the textile material is subjected to heat and pressure. The polymer material liquefies in this step and fuses with the yarn of the textile material.

In a further optional step, the textile material may be pressed into a three-dimensional shape in a machine for compression-molding. For example, the area of the heel or the area of the toes can be three-dimensionally shaped over a last. Alternatively, the textile material may also be directly fitted to a foot.

After pressing and molding, the reaction time until complete stiffening may be one to two days, depending on the type of polymer material used.

The following polymer materials may be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; and polymeric dispersions.

Further, the polymer material may comprise fibers and/or pigments. Thus, the properties of the textile material may be changed. In certain embodiments, the fibers change at least one mechanical property, such as stability, stiffness, cut-resistance, etc. provided by a polymer coating applied to a textile material. In certain embodiments, carbon fibers are added to increase the stability provided by a polymer coating. Further, para-aramid fibers, e.g. Kevlar®, may be added for increased cut resistance. Additionally or alternatively, color pigments may be added to create a desired color appearance of a polymer coating irrespective of the specific polymer material used. The described addition of fibers or pigments does not affect the manufacturing process. Fiber-reinforced polymer material with and without pigments may be sprayed on or applied to the textile material in any of the further ways, as described above. In particular, fibers and pigments may be added to a polymer solution into which the textile material is dipped.

In certain embodiments, a non-woven polymer material e.g. a fleece is applied to the textile material. In these embodiments, the non-woven polymer material may be applied to that surface of the textile material that is to form the inner surface of an upper. Thus, the inner surface of an upper may be manufactured in an advantageous manner. In some embodiments, the non-woven polymer material is applied to the surface of the textile material, which forms the inner surface of an upper, and in addition may be applied to the surface of the textile material forming the outer surface of an upper. Therein, the non-woven polymer material may be applied in the heel and/or toe area. Thus, a convenient feel at the inner surface of an upper and a suitable stability in desired portions of the upper may be provided in a manufacturing step based on a single material.

In some embodiments, the non-woven polymer material is heat pressed or ironed to the respective surface or area of the textile material. According to certain embodiments, the polymer material used has a melting temperature of about 160° C.

The polymer material may comprise a viscosity of about 50-80 Pa·s at about 90-150° C., and may further comprise a viscosity of about 15-50 Pa·s at about 110-150° C.

The hardened polymer material may comprise a hardness of about 40-60 Shore D. Depending on the application, other ranges of hardness are also conceivable.

The described polymer coating is meaningful wherever support functions, stiffening, increased abrasion resistance, elimination of stretchability, increased comfort and/or fitting to prescribed three-dimensional geometries are desired. It is also conceivable to fit a shoe upper to the individual shape of the foot of the person wearing it, by polymer material being applied to the shoe upper and then adapting it to the shape of the foot under heat.

5.5 Monofilaments for Reinforcement

Monofilaments are yarns consisting of one single filament, that is, one single fiber. Therefore, the stretchability of monofilaments is considerably lower than that of yarns that are manufactured from many fibers. As a result also the stretchability of knitted fabrics manufactured from monofilaments is reduced. Monofilaments are typically made from polyamide. However, other materials, such as polyester or other thermoplastic materials, are also conceivable.

Thus, while a textile material made from a monofilament is considerably more rigid and less stretchable, this material does, however, not have the desired surface properties such as e.g. smoothness, colors, transport of moisture, outer appearance and variety of textile structures as usual textile materials have. This disadvantage is overcome by the material described in the following.

Figure 4:
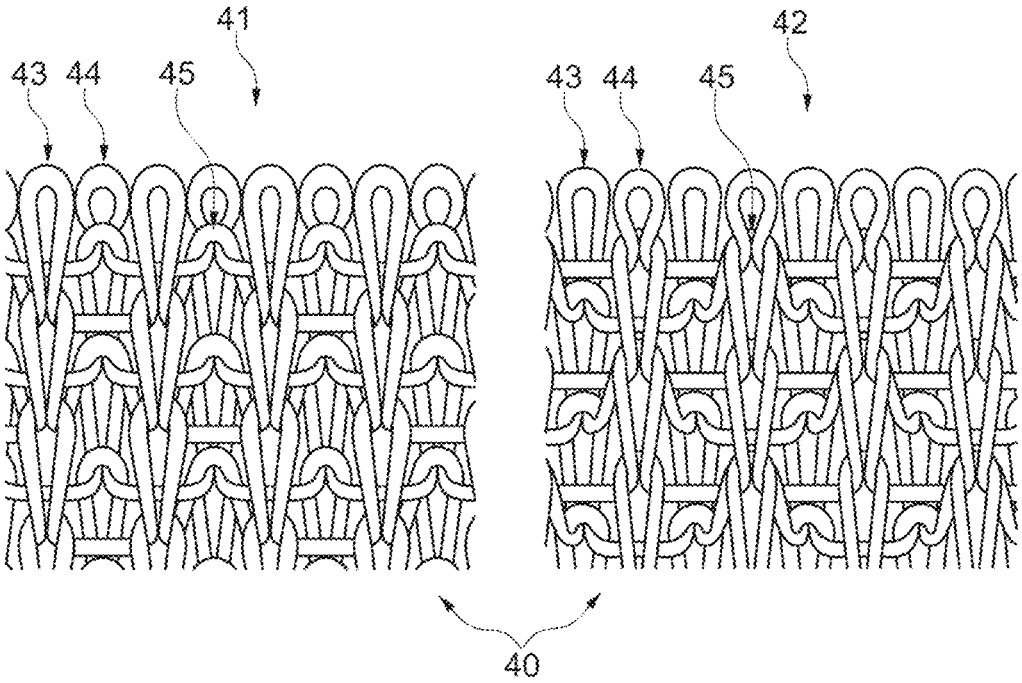
FIG. 4 are front and back views for a weft-knitted fabric according to certain embodiments of the present invention.

FIG. 4 depicts a weft-knitted textile material having a weft-knitted layer made from yarn and a weft-knitted layer made from the monofilament. The layer of monofilament is knitted into the layer of yarn. The resulting two-layered material is considerably more solid and less stretchable than the layer made from yarn alone. If the monofilament is slightly melted, the monofilament connects even better with the yarn.

FIG. 4 particularly depicts a front view 41 and a back view 42 of a two-layered material 40. Both views show a first weft-knitted layer 43 made from a yarn and a second weft-knitted layer 44 made from the monofilament. The first textile layer 43 made from a yarn is connected to the second layer 44 by stitches 45. Thus, the greater solidity and the reduced stretchability of the second textile layer 44 made from the monofilament is transferred to the first textile layer 43 made from the yarn.

The monofilament may also be slightly melted in order to connect with the layer of yarn and to further limit any stretching. The monofilament then fuses with the points of connection with the yarn and fixes the yarn towards the layer made from the monofilament.

5.6 Combination of Monofilaments and Polymer Coating

The weft-knitted material having two layers described in the preceding section may additionally be reinforced by a polymer coating as described in section 5.4. The polymer material is applied to the weft-knitted layer made from monofilaments. It does not connect to the polyamide material of the monofilaments, since the monofilament has a smooth and round surface, but essentially penetrates the underlying layer of yarn. During subsequent pressing, the polymer material therefore fuses with the yarn of the first layer and reinforces the first layer.

The polymer material has a lower melting point than the yarn of the first layer and the monofilament of the second layer, and the temperature during pressing is selected such that only the polymer material melts.

5.7 Fuse Yarn

For reinforcement and for the reduction of stretching, the yarn of a knitted fabric may also be supplemented with thermoplastic material that fixes the knitted fabric after pressing. There are essentially three types of fuse yarn: a thermoplastic yarn surrounded by a non-thermoplastic yarn; a non-thermoplastic yarn surrounded by a thermoplastic yarn; and a pure fuse yarn of a thermoplastic material. In order to improve the bond between the thermoplastic material and the yarn, the yarn's surface is texturized. In certain embodiments, pressing takes place at a temperature ranging from about 110 to 150° C., and may further take place at a temperature of about 130° C. The thermoplastic material melts at least partially in the process and fuses with the yarn. After pressing, the knitted fabric is cooled so that the bond is hardened and stabilized.

In certain embodiments, the fuse yarn is knitted into the knitted fabric. In case of several layers, the fuse yarn may be knitted into one, several, or all layers of the knitted fabric.

In other embodiments, the fuse yarn may be arranged between two layers of a knitted fabric. In doing so, the fuse yarn may simply be placed between the layers. An arrangement between the layers has the advantage that the mold is not contaminated during pressing and molding, since there is no direct contact between the fuse yarn and the mold.

5.8 Further Techniques

Various techniques will be described in the following, which may be relevant to the manufacture of a shoe upper made from knitted fabric (weft-knitted).

A textile material having more than one layer provides further possible constructions for the textile material, which provide many advantages. Several layers fundamentally increase solidness and stability of the textile material. In this regard, the resulting solidity depends on the extent to which, and the techniques by which, the layers are connected to each other. The same material or different materials may be used for the individual layers. A weft-knitted textile material having a weft-knitted layer made from yarn and a weft-knitted layer made from monofilament whose stitches are enmeshed was previously described in section 5.5. In particular, the stretchability of the weft-knitted layer is reduced due to the combination of different materials. It is an advantageous alternative of this construction to arrange a layer made from monofilament between two layers made from yarn in order to reduce stretchability and to increase solidity of the material. A comfortable surface made from yarn is obtained on both sides of the textile material in this way, in contrast to a harder surface made from a monofilament.

Multi-layered constructions also provide opportunities for color design, by different colors being used for different layers.

An alternative of multi-layered constructions are pockets, in which two textile layers are connected to each other only on one side so that a hollow space is created. It is then possible to introduce a foam material, for example, through an opening, e.g. at the tongue, the shoe upper, the heel or in other areas. Alternatively, the pocket may also be filled with a knitted fabric spacer.

A tongue may be manufactured as a continuous piece and connected with the shoe upper subsequently, or it can be manufactured in one piece with the shoe upper. Ridges on the inside may improve the flexibility of the tongue and ensure that a distance is created between the tongue and the foot, which ensures additional ventilation. Laces may be guided through one or several weft-knitted tunnels of the tongue. The tongue may also be reinforced with polymer in order to achieve stabilization of the tongue and e.g. prevent a very thin tongue from convolving. Moreover, the tongue can then also be fitted to the shape of the last or the foot.

Three-dimensional knitted fabrics may be used wherever additional cushioning or protection is desired, e.g. at the shoe upper or the tongue. Three-dimensional structures may also serve to create distances between neighboring textile layers or also between a textile layer and the foot, thus ensuring ventilation.

The knitted fabric is particularly stretchable in the direction of the stitches (longitudinal direction) due to its construction. This stretching may be reduced e.g. by a polymer coating, as described above in section 5.4. The stretching may also be reduced by various measures in the knitted fabric itself. One possibility is reducing the size of the mesh openings, that is, using a smaller needle size. This technique can be used at the shoe upper, for example. Moreover, the stretching of the knitted fabric can be reduced by knitted reinforcement, e.g. three-dimensional structures. Such structures may be arranged on the inside or the outside of a shoe upper. Furthermore, a non-stretchable yarn may be laid in a tunnel in order to limit stretching.

Colored areas with several colors may be created by using a different thread and/or by additional layers. In transitional areas, smaller mesh openings (smaller needle sizes) are used in order to achieve a fluent passage of colors. Further effects may be achieved by weft-knitted inserts (inlaid works) or Jacquard knitting.

5.9 Shoe Upper

Figure 5:
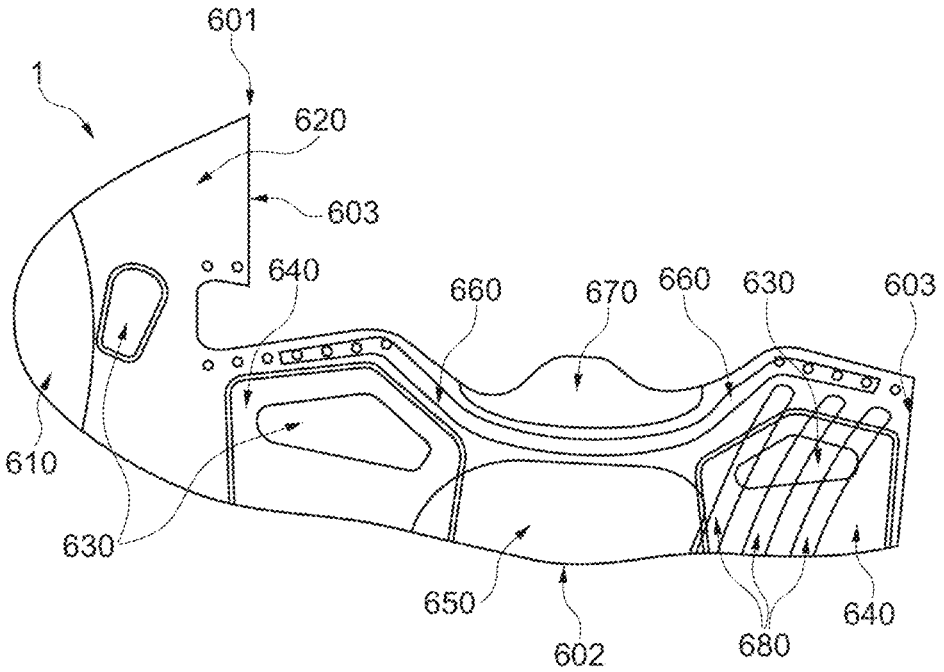
FIG. 5 is a schematic representation of a shoe upper according to certain embodiments of the present invention.

FIG. 5 depicts a schematic representation of a certain embodiments for a shoe upper 1, in which the techniques described above are applied.

The shoe upper 1 depicted in FIG. 5 is weft-knitted in one piece from the top to the bottom, from the first stitch 601 to the last stitch 602. For finishing, the shoe upper 1 is combined along lines 603.

In the area of the toes 610, reinforcement of the shoe upper is advantageous in order to protect the toes from impacts and to offer support to the foot in this exposed area. Moreover, three-dimensional molding may be desirable in this area.

Reinforcement of the textile material may essentially be achieved in four ways. Firstly, a smaller needle diameter may be used, resulting in greater density of stitches and thus greater solidity of the weft-knitted material. Secondly, the area of the toes 610 may be weft-knitted in a multi-layered manner, as described above in section 5.8.

Thirdly, a fuse yarn may be used in one or several layers, as described above in section 5.7. In doing so, a layer may either be entirely weft-knitted from fuse yarn or merely include a fuse yarn. Fourthly, the area 610 may be reinforced by a polymer coating, as described above in section 5.4. By subsequent melting under pressure and heat and the ensuing cooling and hardening, the area of the toes is given substantially greater solidness. Finally, this area can be given a three-dimensional shape by pressure-molding (see section 5.4).

Combining two or more of the aforementioned techniques results in particularly effective reinforcement.

The base area 620 spans large parts of the shoe upper 1. Considerably greater air-permeability is desirable in this area than in the area of the toes 610 and in the area of the heel 650, in order to enable good ventilation of a shoe having the shoe upper 1. In order to solve this problem, a smaller stitch diameter may be used, on the one hand, which gives the weft-knitted material made from yarn great solidness.

On the other hand, apertures are provided for in the weft-knitting pattern, which enable airflow. However, these apertures increase the stretchability of the weft-knitted material. In order to make the resulting weft-knitted material more solid and less stretchable, a second layer made from monofilament is therefore knitted in or connected with the first layer in another manner on the inside of the base area 620. Since the monofilament has a low stretchability, the stretchability of the first layer is also decreased.

Figure 6:
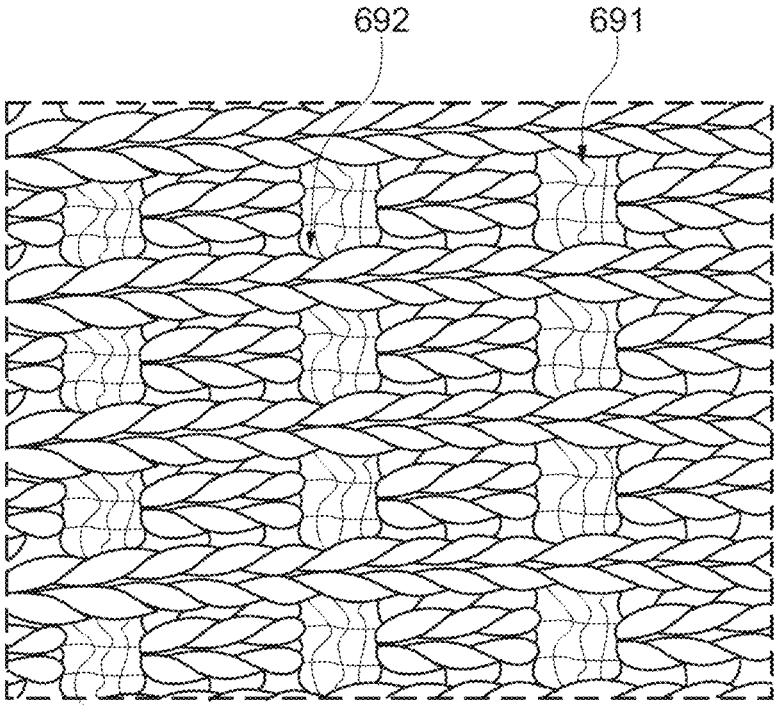
FIG. 6 is a close-up view of a weft-knitted fabric with two layers according to certain embodiments of the present invention.

In order to prevent a significant restriction of air-permeability of the first layer made from yarn, the size of the stitches for the monofilament of the second layer may be larger than that for the yarn on the first layer and/or the thread thickness of the monofilament may be significantly smaller than that of the yarn of the first layer. This can also be seen in FIG. 6: The stitch diameter 692 of the monofilament is so wide and the thread thickness 691 of the monofilament is so small that the apertures of the first layer are not closed and air flow continues to be possible.

In some embodiments, the diameter of the apertures is approximately 1-2 mm and there are approximately 8-12 apertures per $cm^2$. Due to these dimensions, a certain ventilation of the shoe is enabled, on the one hand, and, on the other hand, the two-layered material of the area 620 is of sufficient solidity to support the foot during movement against the occurring forces.

In certain embodiments, a texturized knitting polyester yarn with a yarn thickness of about 660-840 dtx, comprising four to five individual threads, with each individual thread having a yarn thickness of about 160-170 dtx, is used for the base area 620. The unit dtx refers to a yarn with a yarn thickness of about 1 g/10,000 m. According to some embodiments, the base area is weft-knitted with a fine structure of about 12-14 stitches per inch.

The areas 630 are optional and have greater air-permeability than the surrounding areas, e.g. the area 620, due to a wider diameter of the apertures in the pattern of the material and/or a greater density of these apertures.

The areas 640 are arranged on the medial and lateral side of the shoe upper and are manufactured with a suitable pattern of the material in order to ensure support of the foot in these areas. The areas 640 have a smaller diameter of the apertures in the pattern of the material and/or a smaller density of these apertures than the base area 620, in order to achieve greater solidness. In order to reduce stretching, the areas 640 may also be coated with a polymer material, as described in section 5.4.

The area of the heel 650 may also be reinforced by a multi-layered textile material. Furthermore, the area of the heel 650 may be provided with a further layer of monofilament, as described in section 5.5, in order to reduce the stretchability of that area.

Considerable reinforcement of the area of the heel 650 as well as the area of the toes 610 is achieved by using fuse yarn, as described above in section 5.7. Moreover, the area of the heel 650, just as the area of the toes 610, may be coated with a polymer material to reinforce the weft-knitted textile material, as described above in section 5.4. The use of fuse yarn results in stiffer material than a polymer coating, since fuse yarn is capable of forming a thicker layer. On the other hand, using polymer is cheaper than using fuse yarn. Therefore, it may also be possible to apply a polymer coating in different thicknesses, e.g. thicker in the area of the heel 650 and/or the area of the toes 610 than in the medial/lateral areas 640.

The area 660 runs along the area of the shoe's opening and the lacing and is additionally reinforced, e.g. by a multi-layered textile material, which may also comprise a monofilament. In order to further reinforce the material, the area 660 is reinforced with a polymer material, which may have a greater thickness than in the areas 640, e.g. by coating with several layers. Apertures for the laces may be melted through.

Figure 7:
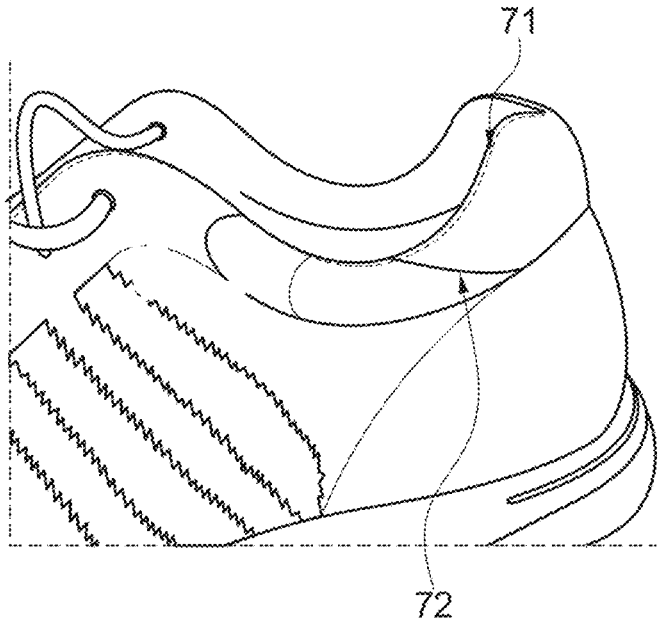
FIG. 7 is a side perspective view of a heel area and a shoe collar of a shoe upper according to certain embodiments of the present invention.

The so-called gusset technique, which is depicted in FIG. 7, can be used for the area 670. The gusset technique enables clustering more knitting stitches, which makes it possible to finalize outlines, particularly round outlines such as the end outline 71 of the upper, in a better and more precise manner. Reference number 72 designates the separation line for the gusset technique.

The area 670 at the upper back end of the shoe upper 1 may e.g. be formed as a pocket by a double-layered material, which is open on one end in order to place a foam material therein for wear comfort and in order to protect the foot. Alternatively, a knitted fabric spacer may provide the desired cushioning. The area 670 is weft-knitted in one piece with the rest of the shoe upper 1. It comprises two layers made from yarn (no monofilament), whereas these two layers are not enmeshed. They are connected on one side such that a pocket is formed.

The structures 680 are embossed by suitable weft-knitting patterns and structures and may be of different colors, respectively. Moreover, a uniform weft-knitting pattern may span the respective strips. A different weft-knitting technique is applied in the area of structures 680, so as to enable a transition of colors. The structures 680 may additionally also be arranged symmetrically in the second one of the areas 640.

Figure 8:
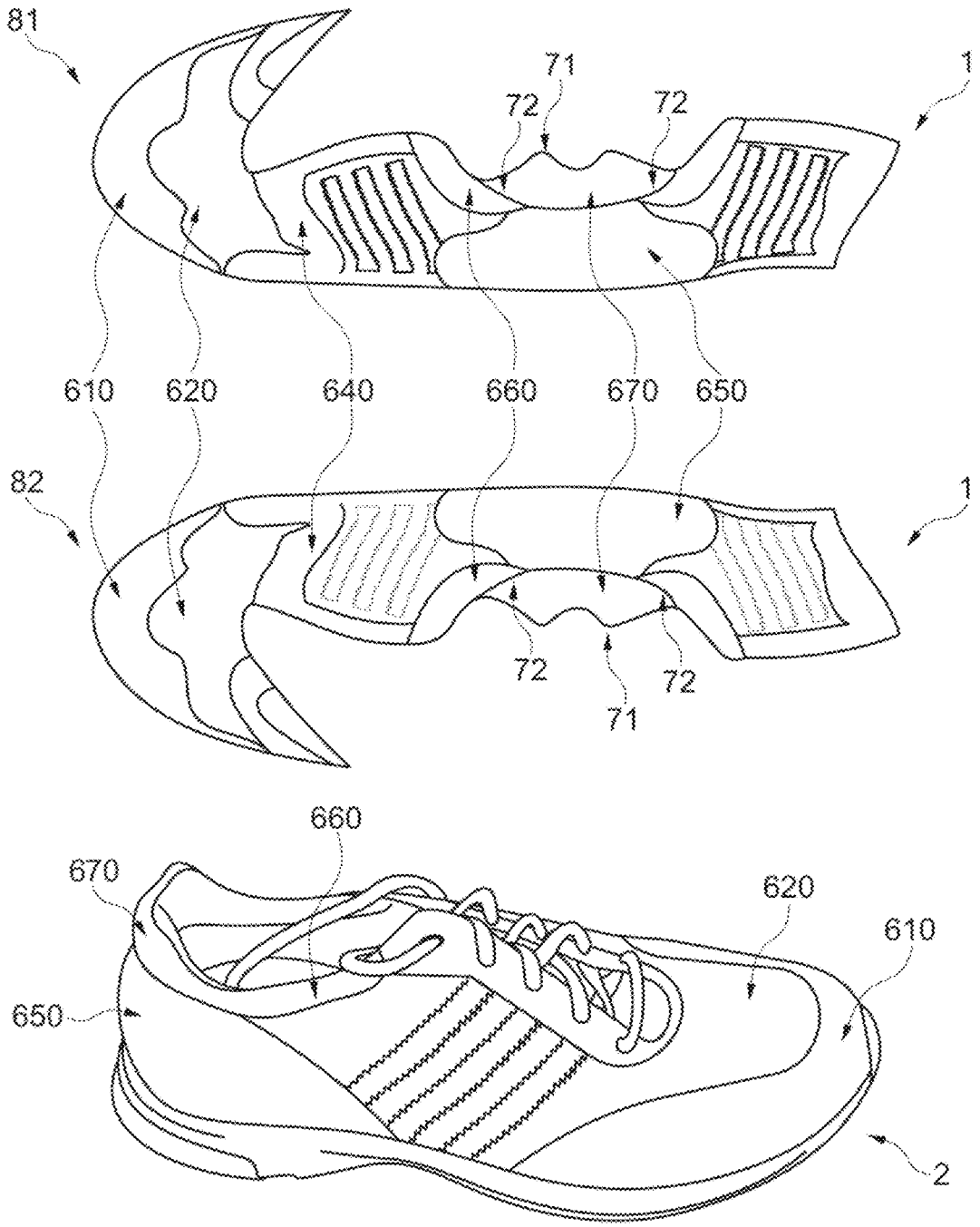
FIG. 8 are top and bottom views of a shoe upper according to certain embodiments of the present invention and a shoe with this shoe upper.

FIG. 8 shows additional embodiments of a shoe upper 1, particularly its outside 81 and its inside 82, as well as an assembled shoe with a shoe upper, whose areas have a different form than in the shoe upper 1, which is depicted in views 81 and 82. FIG. 8 particularly shows the area of the toes 610, the base area 620, the lateral and the medial areas 640, the area of the heel 650, the reinforcement area 660, the area 670 with the pocket, and the structures 680, which were described in connection with FIG. 5. Reference number 72 once again designates the separation line for the gusset technique, which makes it possible to finalize the end outline 71 in a better and more precise manner, as mentioned above.

Figure 9:
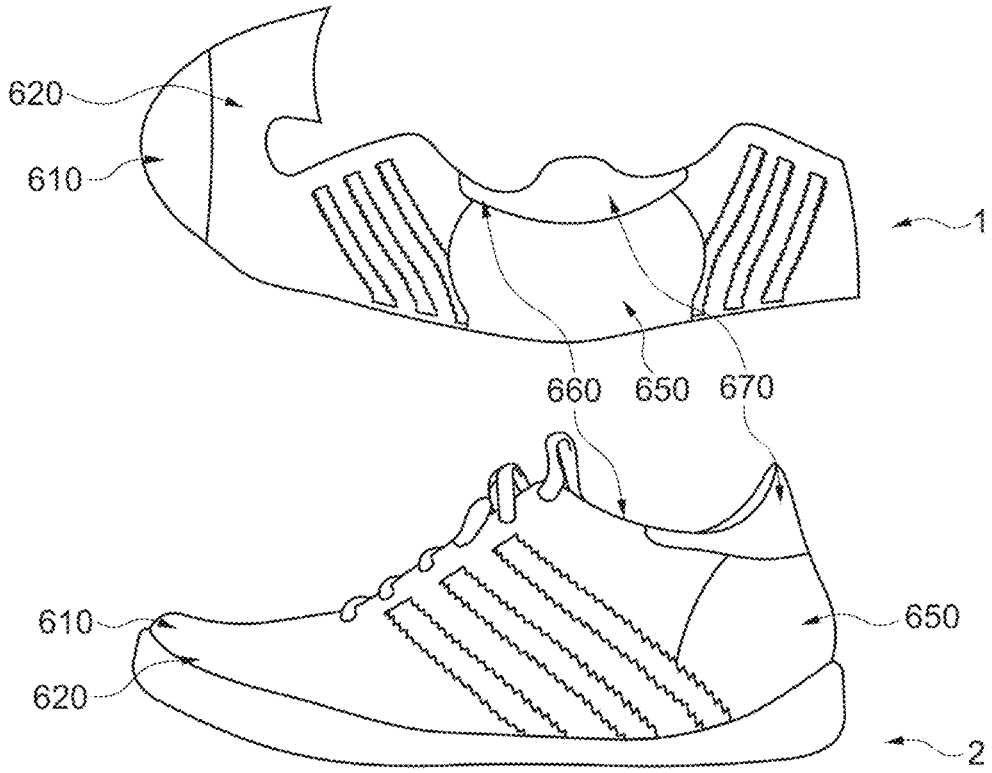
FIG. 9 is a top view of a shoe upper according to certain embodiments of the present invention and a shoe with this shoe upper.

FIG. 9 shows further embodiments of a shoe upper 1 and of a shoe 2 with a shoe upper 1. FIG. 9 once again shows the area of the toes 610, the base area 620, the area of the heel 650, the reinforcement area 660, the area 670 with the pocket and the structures 680, which were described in connection with FIG. 5.

5.10 Computerized Knitting Machines

The manufacture of a shoe upper by knitting can be fully automated on knitting machines, as they are for example provided by the company Stoll. A knitting program is programmed for that purpose, and subsequently the process runs automatically, virtually without further effort. The manufacture of a shoe can be rapidly re-programmed without great effort, i.e. it is possible to change areas, to adjust the size, to exchange yarns and alter patterns of the material without having to change the machine itself.

Thus, the design of the shoe (color, shape, size, fit, function) can be rapidly modified. This is advantageous for production in a factory, as well as for production at a point of sale. Thus, a customer might specify his or her data in a shop and the shoe would subsequently be knitted according to his or her individual dimensions. The shoe can be adjusted to the person wearing it by the shoe upper being adjusted to the shape of the foot of the person wearing the shoe.

Figure 10:
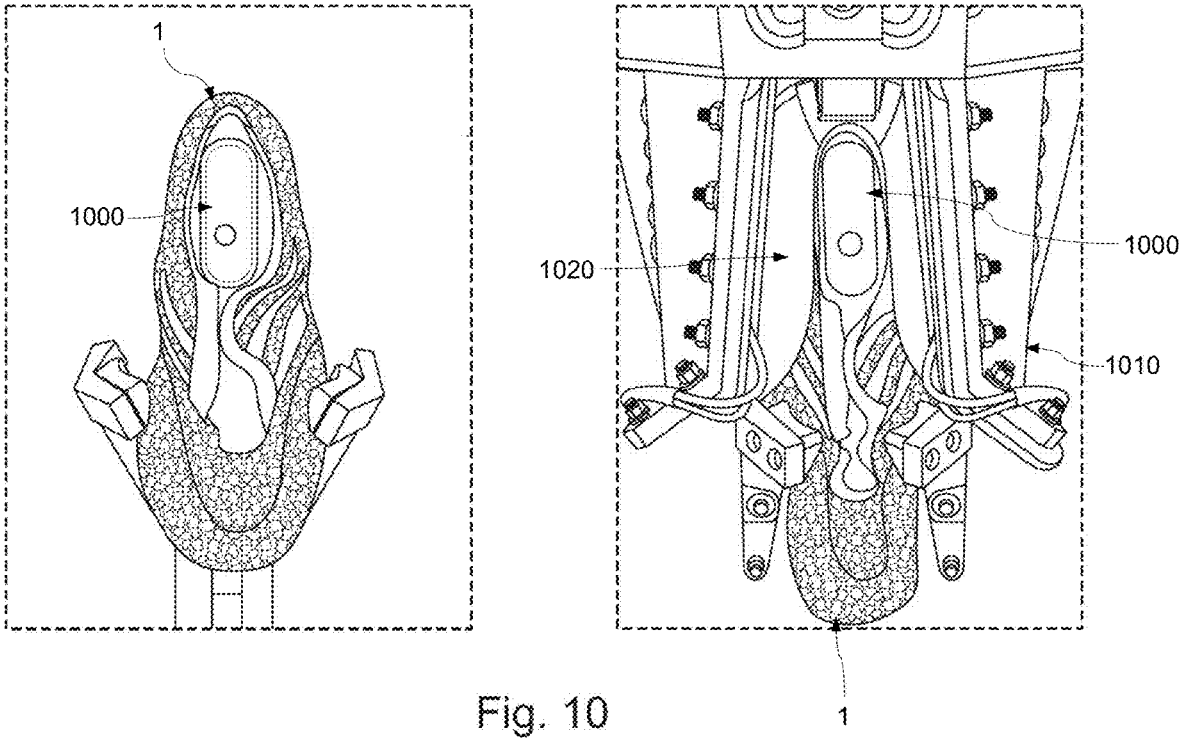
FIG. 10 are views of a three-dimensional molding of a shoe upper according to certain embodiments of the present invention.

To this end, it is possible to adjust areas coated with polymer material (see section 5.4) as well as areas with fuse yarn (see section 5.7) to a last or a foot. FIG. 10 shows how a shoe upper 1 is adjusted to a last 1000 by means of a back-cap preforming machine 1010 (the knitted portions of the shoe upper 1 are schematically shown by the irregular hatch in FIG. 10). In the left part of FIG. 10, the shoe upper 1 has already been placed around the last 1000. In the right part of FIG. 10, the back cap of the shoe upper 1 is pressed against the last 1000 by jaws 1020, whereby the polymer material and/or the fuse yarn melts, which causes the back cap to be permanently deformed according to the shape of the last.

The following examples are described to facilitate a deeper understanding of the invention:

1. Shoe upper (1) for a shoe, in particular a sports shoe (2), having
   a. a first portion and a second portion which are jointly manufactured as a knitted fabric (11, 12, 13);
   b. wherein only one (610, 650) of the first portion and the second portion of the knitted fabric (11, 12, 13) is reinforced by a coating of a polymer material applied to the shoe upper (1).
2. Shoe upper (1) according to the preceding example, wherein the knitted fabric (11, 12) is weft-knitted.

3. Shoe upper (1) according to example 1, wherein the knitted fabric (13) is warp-knitted.
4. Shoe upper (1) according to any one of the preceding examples, wherein yarns of the knitted fabric (11, 12, 13) are positioned by the coating of a polymer material applied to the shoe upper (1).
5. Shoe upper (1) according to any one of the preceding examples, wherein the polymer material comprises fibers and/or pigments.
6. Shoe upper (1) according to one of the preceding examples, wherein the polymer material is applied to the inside of the shoe upper (1).
7. Shoe upper (1) according to one of the preceding examples, wherein the polymer material is applied to the shoe upper in a liquid state.
8. Shoe upper (1) according to one of the preceding examples, wherein the polymer material has a viscosity in the range of 15-80 Pa·s at 90-150° C., preferably 15-50 Pa·s at 110-150° C.
9. Shoe upper (1) according to one of the preceding examples, wherein the applied polymer material has a hardness in the range of 40-60 shore D.
10. Shoe upper (1) according to one of the preceding examples, wherein the polymer material is applied with a thickness of 0.2-1 mm in at least one layer.
11. Shoe upper (1) according to example 10, wherein the polymer material is applied in several layers.
12. Shoe upper (1) according to the preceding example, wherein at least two layers have different thicknesses.
13. Shoe upper (1) according to one of the preceding examples, wherein the portion which is reinforced with the polymer material is arranged in the toe area (610).
14. Shoe upper (1) according to one of the preceding examples, wherein the portion which is reinforced with the polymer material is arranged in the heel area (650).
15. Shoe upper (1) according to one of the preceding examples, wherein the portion which is reinforced with the polymer material is arranged on a lateral side and/or a medial side in the midfoot area of the shoe upper.
16. Shoe upper (1) according to one of the preceding examples, wherein the first and/or the second portion of the knitted fabric (11, 12, 13) comprises a first textile layer and a second textile layer, wherein the first textile layer comprises a yarn, and wherein the second textile layer comprises a monofilament.
17. Shoe upper (1) according to the preceding example, wherein the portion in which the knitted fabric (11, 12, 13) is reinforced by a coating of a polymer material applied to the shoe upper (1) comprises the first textile layer and the second textile layer.
18. Shoe upper (1) according to the preceding example, wherein the polymer material is arranged on the second textile layer.
19. Shoe upper (1) according to one of the examples 16-18, wherein the portion comprising the first textile layer and the second textile layer is arranged in the area of the toes, the midfoot, the heel and/or the lacing of the shoe upper (1).
20. Shoe upper (1) according to one of the preceding examples, wherein the knitted fabric (11, 12, 13) further comprises a fuse yarn which comprises a thermoplastic material.
21. Shoe upper (1) according to one of the examples 16-19 in connection with example 19, wherein the fuse yarn is arranged in the first textile layer and/or the second textile layer.
22. Shoe upper (1) according to example 20, wherein the fuse yarn is arranged between the first textile layer and the second textile layer.
23. Shoe upper (1) according to one of the preceding claims, wherein the polymer material comprises a non-woven polymer material.
24. Shoe upper (1) according to one of the examples 2 or 3 in connection with one of the examples 16-22, wherein the first textile layer and the second textile layer are connected by weft-knitting or by warp-knitting.
25. Shoe upper (1) for a shoe, in particular a sports shoe (2), having
    a. at least one portion which comprises a weft-knitted material;
    b. wherein the weft-knitted material comprises a first weft-knitted layer of a yarn and a second weft-knitted layer of a monofilament;
    c. wherein the second weft-knitted layer and the first weft-knitted layer are connected such that the stretching of the first weft-knitted layer is reduced by the second weft-knitted layer.
26. Shoe upper (1) for a shoe according to example 25, wherein the second weft-knitted layer is only connected to the first weft-knitted layer.
27. Shoe upper (1) for a shoe according to example 25 or 26, wherein the first textile layer and the second textile layer are knitted to each other.
28. Shoe upper (1) for a shoe according to one of the examples 25-27, wherein the first textile layer comprises apertures for airing.
29. Shoe upper (1) for a shoe according to one of examples the 25-28, wherein the second textile layer comprises larger stitches than the first textile layer.
30. Method of manufacture of a shoe upper (1) for a shoe, in particular a sports shoe (2), wherein the shoe upper comprises a first portion and a second portion which are jointly manufactured as a knitted fabric (11, 12, 13), comprising the step of:
    applying a polymer layer as a coating in only one (610, 650) of the first portion and the second portion of the shoe upper (1).
31. Method of manufacture of a shoe upper (1) according to the preceding example, further comprising the step of pressing the polymer-coated portion of the shoe upper (1) under pressure and heat.
32. Method of manufacture of a shoe upper (1) according to one of the examples 30-31, wherein the polymer layer is sprayed on.
33. Method of manufacture of a shoe upper (1) according to one of the examples 31-32, wherein the polymer layer is applied by coating with a doctor knife or laying on.
34. Method of manufacture of a shoe upper (1) according to one of the examples 30-31, wherein the polymer material is applied by dipping the knitted fabric (11, 12, 13) at least in part into a polymer solution.
35. Method of manufacture of a shoe upper (1) according to example 30, wherein the polymer material comprises a non-woven polymer material, and wherein the step of applying involves heat pressing the non-woven polymer material onto the knitted fabric.
36. Method of manufacture of a shoe upper (1) according to one of the examples 30-35, wherein the knitted fabric (11, 12, 13) comprises a first textile layer and a second textile layer, wherein the first textile layer comprises a yarn and wherein the second textile layer comprises a monofilament, further comprising the steps of:

applying a polymer material to the second layer; and pressing the shoe upper (1) under pressure and temperature, wherein the polymer material melts and then penetrates the second textile layer and substantially coats the first textile layer.

37. Method of manufacture of a shoe upper (1) according to one of the examples 30-36, wherein the method further comprises:

compression-molding the textile material.

38. Method of manufacture of a shoe upper (1) according to one of the examples 36-37, wherein the monofilament and the yarn comprise a higher melting point than the polymer layer.

39. Method of manufacture of a shoe upper (1) according to one of the examples 30-38, wherein the yarn comprises a fuse yarn which comprises a thermoplastic material.

40. Method of manufacture of a shoe upper (1) according to the example 39, wherein the monofilament and the yarn comprise a higher melting point than the thermoplastic material of the fuse yarn.

41. Method of manufacture of a shoe upper (1) according to any of the preceding examples 30-40, wherein the polymer material is applied to the inside of the shoe upper (1).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method of manufacture of a shoe upper for a shoe, the method comprising:

forming a shoe upper from a knitted fabric, the shoe upper comprising a first portion and a toe portion which are jointly manufactured as the knitted fabric, wherein the knitted fabric comprises a first textile layer and a second textile layer, the second textile layer comprising synthetic monofilament yarn, wherein the first portion comprises a ventilation area with a plurality of apertures formed in the knitted fabric, and wherein at least one of the apertures are spanned with only the synthetic monofilament yarn such that the plurality of apertures allow air flow through the first portion;

applying a polymer material in a liquid state to the second textile layer in only the first portion to reinforce the ventilation area with respect to the toe portion of the shoe upper such that the polymer material is a liquid when it initially contacts the second textile layer, wherein the liquid polymer material does not connect to the synthetic monofilament yarn and penetrates through the second textile layer to fuse with a yarn of the first textile layer.

2. The method of manufacture of a shoe upper according to claim 1, wherein the liquid polymer material is applied by dipping the knitted fabric at least in part into a polymer solution.

3. The method of manufacture of a shoe upper according to claim 1, further comprising the steps of:

pressing the shoe upper under pressure and temperature, wherein the liquid polymer material substantially coats portions of the first textile layer.

4. The method according to claim 1, wherein the liquid polymer material is applied to the inside of the shoe upper.

5. The method according to claim 1, wherein the liquid polymer material has a lower melting point than the yarn of the first textile layer and the synthetic monofilament yarn.

6. A method of manufacturing a shoe upper, the method comprising:

knitting a first textile layer;

knitting a second textile layer comprising a synthetic monofilament yarn;

knitting the synthetic monofilament yarn of the second textile layer to the first textile layer by enmeshing weft-knitted stitches of the synthetic monofilament yarn with weft-knitted stitches of the first textile layer such that the stretchability of the first textile layer is reduced;

forming the first textile layer and the synthetic monofilament yarn into the shoe upper, wherein the shoe upper comprises a first portion, a toe portion, and a second portion disposed between the first portion and the toe portion, wherein the first portion comprises a ventilation area with a plurality of apertures formed in the first textile layer, and wherein at least one of the apertures are spanned with only the synthetic monofilament yarn such that the plurality of apertures allow air flow through the first portion; and applying a polymer material as a coating in only the first portion and the toe portion, wherein the polymer material does not connect to the synthetic monofilament yarn in the ventilation area.

7. The method of claim 6, wherein the polymer material is a liquid, and wherein applying the polymer material comprises dipping the shoe upper into the liquid polymer material.

8. The method of claim 6, wherein forming the shoe upper further comprises applying heat to partially melt the synthetic monofilament.

9. The method of claim 6, further comprising knitting a fuse yarn into the first textile layer, wherein the first portion does not comprise fuse yarn; and applying heat to the shoe upper such that the fuse yarn partially melts and fuses with a yarn in the first textile layer.

10. The method of claim 9, wherein a melting point of the yarn in the first textile layer and a melting point of the synthetic monofilament yarn are higher than a melting point of the fuse yarn, and wherein the heat is applied at a temperature above the melting point of the fuse yarn but below the melting point of the yarn and the melting point of the synthetic monofilament yarn.

11. The method of claim 6, further comprising knitting a second textile layer, wherein the synthetic monofilament yarn is disposed between the first textile layer and the second textile layer.

12. The method of claim 11, further comprising arranging a fuse yarn between the first textile layer and the second textile layer; and molding the shoe upper by placing the shoe upper in a mold and applying heat, wherein the fuse yarn is contained by the first textile layer and the second textile layer such that the fuse yarn does not contact the mold, and wherein the fuse yarn is at least partially melted and fuses with a yarn in one of the first textile layer and the second textile layer during molding.

13. The method of claim 12, wherein the molding step further comprises applying pressure to the shoe upper using the mold such that the shoe upper is formed into a three dimensional shape; and allowing the polymer coating in the first or toe portion to cure and stiffen the first or toe portion into a three dimensional shape.

14. The method of claim 6, wherein the polymer material has a lower melting point than a yarn of the first textile layer and the synthetic monofilament yarn.

15. The method of claim 1, further comprising knitting a second portion between the toe portion and the first portion, the second portion not comprising the polymer coating, and the second portion comprising a second ventilation area comprising a plurality of apertures in the first textile layer.

16. The method of claim 1, further comprising knitting a fuse yarn into the knitted fabric at the toe portion, wherein the first portion does not comprise the fuse yarn.

17. The method of claim 10, wherein the temperature is between 110 degrees to 150 degrees Celsius.

* * * * *